US012049821B2

(12) United States Patent
Machocki et al.

(10) Patent No.: US 12,049,821 B2
(45) Date of Patent: Jul. 30, 2024

(54) STRADDLE PACKER TESTING SYSTEM

(71) Applicant: Saudi Arabian Oil Company, Dhahran (SA)

(72) Inventors: Krzysztof Karol Machocki, Scotland (GB); Ismail Adebiyi, Dhahran (SA); Ahmed Jaafari, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 1304 days.

(21) Appl. No.: 16/258,930

(22) Filed: Jan. 28, 2019

(65) Prior Publication Data

US 2020/0240265 A1 Jul. 30, 2020

(51) Int. Cl.

| | |
|---|---|
| ***E21B 49/08*** | (2006.01) |
| ***E21B 21/08*** | (2006.01) |
| ***E21B 21/10*** | (2006.01) |
| ***E21B 23/06*** | (2006.01) |
| ***E21B 44/00*** | (2006.01) |

(52) U.S. Cl.

CPC ..... *E21B 49/088* (2013.01); *E21B 21/08* (2013.01); *E21B 21/103* (2013.01); *E21B 23/06* (2013.01); *E21B 44/005* (2013.01); *E21B 49/081* (2013.01)

(58) Field of Classification Search

CPC ..... E21B 49/088; E21B 21/08; E21B 21/103; E21B 23/06; E21B 44/005; E21B 49/081

See application file for complete search history.

(56) References Cited

U.S. PATENT DOCUMENTS

| | | | | |
|---|---|---|---|---|
| 2,043,225 A | | 6/1936 | Armentrout et al. | |
| 2,227,729 A | | 1/1941 | Lynes | |
| 2,825,044 A | * | 2/1958 | Peterson | E21B 47/085 367/27 |
| RE32,345 E | | 3/1987 | Wood | |

(Continued)

FOREIGN PATENT DOCUMENTS

| | | |
|---|---|---|
| CA | 2249432 | 9/2005 |
| CA | 2594042 | 8/2012 |

(Continued)

OTHER PUBLICATIONS https://web.archive.org/web/20170203171116/https://www.merriam-webster.com/dictionary/adjacent; Date: Feb. 3, 2017 (Year: 2017).*

(Continued)

*Primary Examiner* — Christopher J Sebesta
*Assistant Examiner* — Neel Girish Patel
(74) *Attorney, Agent, or Firm* — Fish & Richardson P.C.

(57) ABSTRACT

Testing a fluid in a wellbore with a well testing tool carried on a well testing string includes activating a first selectively controllable longitudinal valve and a second selectively controllable longitudinal valve with a communication module. A first and second packer of the well testing tool engages an inner wall of the wellbore to define a zone of interest between the first packer and the second packer. The communication module further activates a selectively controllable radial valve positioned between the first packer and the second packer to flow fluid between the central bore and the annulus formed between the first packer and the second packer, a fluid sample flows from the annulus between the first packer and the second packer through the testing string to a tophole facility.

26 Claims, 14 Drawing Sheets

(56) References Cited

U.S. PATENT DOCUMENTS

| | | | | |
|---|---|---|---|---|
| 5,803,186 | A | 9/1998 | Berger et al. | |
| 6,047,239 | A * | 4/2000 | Berger | E21B 49/08 702/9 |
| 6,142,229 | A * | 11/2000 | Branson, Jr. | E21B 43/2405 166/250.15 |
| 6,330,913 | B1 | 12/2001 | Langseth et al. | |
| 6,347,666 | B1 * | 2/2002 | Langseth | E21B 49/081 166/252.1 |
| 6,357,525 | B1 * | 3/2002 | Langseth | E21B 49/088 166/266 |
| 6,581,455 | B1 * | 6/2003 | Berger | E21B 49/10 73/152.55 |
| 6,622,554 | B2 | 9/2003 | Manke et al. | |
| 7,086,463 | B2 | 8/2006 | Ringgenberg et al. | |
| 7,124,819 | B2 | 10/2006 | Ciglenec et al. | |
| 7,647,980 | B2 | 1/2010 | Corre et al. | |
| 9,051,810 | B1 | 6/2015 | Cuffe et al. | |
| 9,238,961 | B2 | 1/2016 | Bedouet | |
| 9,366,123 | B2 * | 6/2016 | Fehr | E21B 43/164 |
| 9,494,010 | B2 | 11/2016 | Flores | |
| 10,871,069 | B2 | 12/2020 | Adebiyi | |
| 11,475,316 | B2 * | 10/2022 | Zheng | G06N 5/02 |
| 2001/0050170 | A1 * | 12/2001 | Woie | E21B 49/008 166/250.07 |
| 2002/0066563 | A1 | 6/2002 | Langseth et al. | |
| 2003/0234120 | A1 * | 12/2003 | Paluch | E21B 49/082 175/50 |
| 2004/0163811 | A1 * | 8/2004 | McKee | E21B 33/124 166/305.1 |
| 2005/0022987 | A1 | 2/2005 | Green et al. | |
| 2006/0124297 | A1 * | 6/2006 | Ohmer | E21B 17/003 166/250.01 |
| 2006/0248949 | A1 | 11/2006 | Gregory et al. | |
| 2008/0053652 | A1 | 3/2008 | Corre et al. | |
| 2010/0006339 | A1 | 1/2010 | Desai | |
| 2011/0005745 | A1 * | 1/2011 | Goodwin | E21B 49/10 166/250.01 |
| 2011/0155368 | A1 | 6/2011 | El-Khazindar | |
| 2012/0305315 | A1 * | 12/2012 | Bedouet | E21B 33/124 175/50 |
| 2013/0118751 | A1 * | 5/2013 | Landsiedel | E21B 43/26 166/308.1 |
| 2014/0076546 | A1 * | 3/2014 | Patel | E21B 43/14 166/250.01 |
| 2014/0202689 | A1 * | 7/2014 | Walton | E21B 47/12 166/99 |
| 2014/0299383 | A1 * | 10/2014 | Tao | E21B 49/081 175/236 |
| 2014/0300895 | A1 | 10/2014 | Pope et al. | |
| 2015/0007985 | A1 * | 1/2015 | Gisolf | E21B 49/008 166/66 |
| 2015/0027724 | A1 | 1/2015 | Symms | |
| 2015/0034323 | A1 * | 2/2015 | Greene | E21B 43/12 166/305.1 |
| 2015/0167442 | A1 * | 6/2015 | Harfoushian | E21B 43/267 166/264 |
| 2015/0176376 | A1 * | 6/2015 | Gisolf | E21B 43/12 166/250.01 |
| 2015/0176392 | A1 * | 6/2015 | Corre | E21B 47/005 166/250.01 |
| 2018/0051353 | A1 | 2/2018 | Valdez et al. | |
| 2018/0051535 | A1 * | 2/2018 | Wang | E21B 34/10 |
| 2018/0163510 | A1 * | 6/2018 | Cleven | E21B 43/26 |
| 2019/0203567 | A1 * | 7/2019 | Ross | E21B 49/008 |
| 2019/0264518 | A1 * | 8/2019 | Al-Gouhi | F04D 25/0606 |
| 2019/0284933 | A1 * | 9/2019 | Tiwari | E21B 34/06 |
| 2020/0240265 | A1 * | 7/2020 | Machocki | E21B 47/06 |
| 2020/0300052 | A1 * | 9/2020 | Johnson | E21B 47/117 |
| 2021/0131283 | A1 * | 5/2021 | Jones | E21B 49/10 |
| 2021/0363872 | A1 * | 11/2021 | Jamison | G01V 15/00 |
| 2021/0404332 | A1 * | 12/2021 | Elhawary | E21B 49/008 |
| 2022/0220844 | A1 * | 7/2022 | Al-Dhafeeri | E21B 47/00 |

FOREIGN PATENT DOCUMENTS

| | | |
|---|---|---|
| WO | 9721904 | 6/1997 |
| WO | WO 9735093 | 9/1997 |
| WO | 02/20944 | 3/2002 |
| WO | 2017196303 | 11/2017 |

OTHER PUBLICATIONS https://web.archive.org/web/20161220024051/https://www.amci.com/industrial-automation-resources/plc-automation-tutorials/what-plc/; Dated Dec. 20, 2016 (Year: 2016).*

PCT Invitation to Pay Additional Fees and, Where Applicable, Protest Fee issued in International Application No. PCT/US2020/015215 on Jun. 9, 2020, 19 pages.

International Search Report and Written Opinion issued in International Application No. PCT/US2019/067852 on Mar. 25, 2020, 15 pages.

PCT International Search Report and Written Opinion issued in International Application No. PCT/US2020/015215 on Jul. 31, 2020, 23 pages.

GCC Examination Report issued in Gulf Cooperation Council Application No. GC 2020-39059, dated Jun. 16, 2021, 5 pages.

GCC Examination Report issued in Gulf Cooperation Council Application No. GC 2020-38948, dated Apr. 16, 2021, 5 pages.

Schlumberger, "CERTIS: Retrievable, single-trip, production-level isolation system," www.slb.com/CERTIS, 2017, 2 pages.

Weatherford, "RFID Advanced Reservoir Management System Optimizes Injection Well Design, Improves Reservoir Management," Weatherford.com, 2013, 2 pages.

Wellbore Service Tools: Retrievable tools, "RTTS Packer," Halliburton: Completion Tools, 2017, 4 pages.

EPO Communication Pursuant to Article 94(3) EPC in European Appln. No. 20708782.6, dated Apr. 6, 2023, 4 pages.

SAIP Examination Report in SAIP Appln. No. 521422447, dated Mar. 9, 2023, 10 pages, with English Translation.

SAIP Examination Report in Saudi Arabian Appln. No. 521422628, dated May 31, 2023, 22 pages (with English Translation).

* cited by examiner

STRADDLE PACKER TESTING SYSTEM

TECHNICAL FIELD

This disclosure relates to testing of wellbores, for example, open-hole wellbores, with a straddle packer system.

BACKGROUND

In the oil and gas industries, some wellbores undergo evaluation tests and acid treatments to treat the wellbores and determine if petroleum can be produced from a reservoir in a cost-effective manner. This treatment and testing often requires a casing to be run and cemented, which can impact treatment and evaluation in the case of poor cement jobs. Also, control and operation of many testing tools, such as packers and flapper valves, from the surface can be difficult to implement in conventional testing and treatment systems.

SUMMARY

This disclosure describes testing fluid in a wellbore with a well testing tool, for example, disposed on a testing string.

Some aspects of the disclosure encompass a method for testing a fluid in a wellbore. The method includes positioning a well testing tool carried on a testing string downhole in a wellbore at a zone of interest of the wellbore. The well testing tool includes a housing, a central bore extending from a first longitudinal end to a second, opposite longitudinal end of the well testing tool, and a first packer and a second packer that circumscribe a portion of the housing of the well testing tool. The first packer is positioned uphole of the second packer, and the well testing tool is to define an annulus between the housing and an inner wall of the wellbore. The method also includes activating, with a communication module, a first selectively controllable longitudinal valve positioned uphole of the first packer to allow fluid flow through the central bore at the first selectively controllable longitudinal valve, and activating, with the communication module, a second selectively controllable longitudinal valve positioned downhole of the second packer to selectively plug the central bore from fluid flow along the central bore at the second selectively controllable longitudinal valve. The method further includes engaging, with the first packer of the well testing tool, the inner wall of the wellbore, engaging, with the second packer of the well testing tool, the inner wall of the wellbore, activating, with the communication module, a selectively controllable radial valve positioned between the first packer and the second packer to flow fluid between the central bore and the annulus formed between the first packer and the second packer, and flowing a fluid sample from the annulus between the first packer and the second packer through the testing string to a tophole facility.

This, and other aspects, can include one or more of the following features. The method can further include measuring a pressure in the annulus between the first packer and the second packer with a pressure sensor positioned on the housing of the well testing tool, and communicating the measured pressure from the pressure sensor to the tophole facility with the communication module. The communication module can include a transmitter to transmit signals to and receive signals from the first selectively controllable longitudinal valve, the second selectively controllable longitudinal valve, the selectively controllable radial valve, the first packer, the second packer, and the pressure sensor. The communication module can include at least one of smart coil tubing, coil tubing, slickline, or e-line. Activating the selectively controllable radial valve with the communication module can include positioning the transmitter of the communication module proximate to the selectively controllable radial valve to activate the selectively controllable radial valve. Flowing a fluid sample from the annulus to a tophole facility can include flowing the fluid sample to the tophole facility through a fluid communication pathway of the communication module. Running a well testing tool downhole in a wellbore can include running the well testing tool to an open-hole portion of the wellbore, engaging the wall of the wellbore with the first packer can include engaging a wall of the open-hole portion of the wellbore with the first packer, and engaging the wall of the wellbore with the second packer can include engaging the wall of the open-hole portion of the wellbore with the second packer. Engaging the wall of the wellbore with the first packer and the second packer can include isolating a zone of interest of the wellbore between the first packer and the second packer. The method can include, in response to activating the selectively controllable radial valve with the communication module, activating a second selectively controllable radial valve positioned uphole of the first packer with the communication module to flow fluid between the central bore and the annulus formed uphole of the first packer. The method can include, in response to positioning the well testing tool carried on the testing string downhole in the wellbore, at least one of pressure testing the well testing tool or drift testing the well testing tool. The method can include, in response to activating the selectively controllable radial valve with the communication module, treating the zone of interest of the wellbore with an acid treatment. The method can further include deactivating the selectively controllable radial valve to plug fluid flow between the central bore and the annulus formed between the first packer and the second packer, disengaging the first packer from the wall of the wellbore, disengaging the second packer from the wall of the wellbore, and positioning the well testing tool carried on the testing string at a second, different zone of interest of the wellbore.

In some aspects, a well testing system for use in a wellbore includes a retrievable well testing tool including a housing and a central bore, the well testing tool to be positioned in a wellbore of a well. The well testing tool includes a first packer and a second packer that circumscribe a portion of the housing of the well testing tool, the first packer positioned uphole of the second packer, the first packer and the second packer to selectively engage and seal against a wall of the wellbore. The well testing tool also includes a first selectively controllable radial valve uphole of the first packer to selectively communicate fluid between the central bore and an annulus uphole of the first packer, the annulus being between the well testing tool and the wall of the wellbore, a second selectively controllable radial valve between the first packer and the second packer to selectively communicate fluid between the central bore and the annulus between the first packer and the second packer, a first selectively controllable longitudinal valve uphole of the first packer to selectively plug the central bore from fluid flow along the central bore, a second selectively controllable longitudinal valve downhole of the second packer to selectively plug the central bore from fluid flow along the central bore, and a receiver communicatively coupled to the first packer, second packer, first selectively controllable radial valve, second selectively controllable radial valve, first selectively controllable longitudinal valve, and second selectively controllable longitudinal valve. The well testing system also includes a communication module to communicate with the receiver to control activation of the first packer, second packer, first selectively controllable radial valve, second selectively controllable radial valve, first selectively controllable longitudinal valve, and second selectively controllable longitudinal valve.

This, and other aspects, can include one or more of the following features. The first selectively controllable radial valve can include a mud displacement valve, the mud displacement valve including communication ports fluidly coupling the central bore of the well testing tool with an annulus of the wellbore adjacent the mud displacement valve, the communication ports to selectively actuate open and closed. The well testing system can include a straddle tubing formed in the housing of the well testing tool between the first packer and the second packer, the straddle tubing including the second selectively controllable radial valve, the second selectively controllable radial valve comprising straddle communication ports configured to selectively actuate open and closed. The communication module can include at least one of smart coil tubing, coil tubing, slickline, or e-line, and the communication module can include a transmitter configured to transmit and receive signals from the well testing tool. The communication module can include a fluid communication pathway to transmit fluids between a downhole end of the communication module and an opposite, uphole end of the communication module. The well testing tool can include a communication device that is complementary with the communication module to communicate with the communication module. The communication device can include the receiver of the well testing tool. The communication module can include at least one of a telemetric communication, a wireline communication, a wired communication over cables, a wireless communication with receivers and transmitters, or a drop plug communication. The central bore can include a full-bore pass through along an entire longitudinal length of the well testing tool, where the central bore can allow a pass through of the communication module through the central bore. The well testing system can further include a controller communicatively coupled to the first packer, the second packer, the first selectively controllable radial valve, the second selectively controllable radial valve, the first selectively controllable longitudinal valve, and the second selectively controllable longitudinal valve, where the controller selectively activates the first packer, the second packer, the first selectively controllable radial valve, the second selectively controllable radial valve, the first selectively controllable longitudinal valve, and the second selectively controllable longitudinal valve according to a pre-programmed testing sequence. The well testing tool can include a downhole logic tool coupled to the well testing tool and can include the controller, where the downhole logic tool can include interlocks configured to prevent activation of a component of the well testing tool out of sequence from the pre-programmed testing sequence. The well testing tool can further include a pressure sensor coupled to the housing and positioned between the first packer and the second packer, the pressure sensor to monitor a pressure in an annulus between the first packer and second packer and between the second selectively controllable valve and a wall of the wellbore. The well testing tool can further include a second pressure sensor coupled to the housing and positioned uphole of the first packer, the second pressure sensor to monitor a pressure in the annulus uphole of the first packer, and a third pressure sensor coupled to the housing and positioned downhole of the second packer, the third pressure sensor to monitor a pressure in the annulus downhole of the second packer. The well testing tool can further include a backup packer positioned uphole of the first packer to selectively engage and seal against the wall of the wellbore, and a backup sleeve valve positioned between the first packer and the backup packer, the backup sleeve valve to selectively flow fluid between the central bore and a portion of the annulus between the first packer and the backup packer. The well testing tool can further include a backup packer positioned downhole of the second packer to selectively engage and seal against the wall of the wellbore, and a backup sleeve valve positioned between the second packer and the backup packer, the backup sleeve valve to selectively flow fluid between the central bore and a portion of the annulus between the second packer and the backup packer.

In certain aspects, a well testing tool for use in a wellbore includes a first packer and a second packer circumscribing a portion of a housing of the well testing tool, the first packer and the second packer to selectively engage and seal against a wall of the wellbore, a first selectively controllable radial valve uphole of the first packer to selectively communicate fluid between a central bore of the housing and an annulus uphole of the first packer, the annulus being between the well testing tool and the wall of the wellbore, a second selectively controllable radial valve between the first packer and the second packer to selectively communicate fluid between the central bore and the annulus between the first packer and the second packer, a first selectively controllable longitudinal valve uphole of the first packer to selectively plug the central bore from fluid flow along the central bore, a second selectively controllable longitudinal valve downhole of the second packer to selectively plug the central bore from fluid flow along the central bore, a pressure sensor coupled to the housing and positioned between the first packer and the second packer, the pressure sensor to monitor a pressure in an annulus between the first packer and second packer and between the second selectively controllable valve and a wall of the wellbore, and a controller communicatively coupled to the first packer, the second packer, the first selectively controllable valve, the second selectively controllable valve, and the pressure sensor. The controller selectively activates the first packer, the second packer, the first selectively controllable radial valve, the second selectively controllable radial valve, the first selectively controllable longitudinal valve, the second selectively controllable longitudinal valve, and the pressure sensor according to a pre-programmed testing sequence.

This, and other aspects, can include one or more of the following features. The well testing tool can include a downhole logic tool coupled to the well testing tool and including the controller. The downhole logic tool can include interlocks to prevent activation of a component of the well testing tool out of sequence from the pre-programmed testing sequence.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
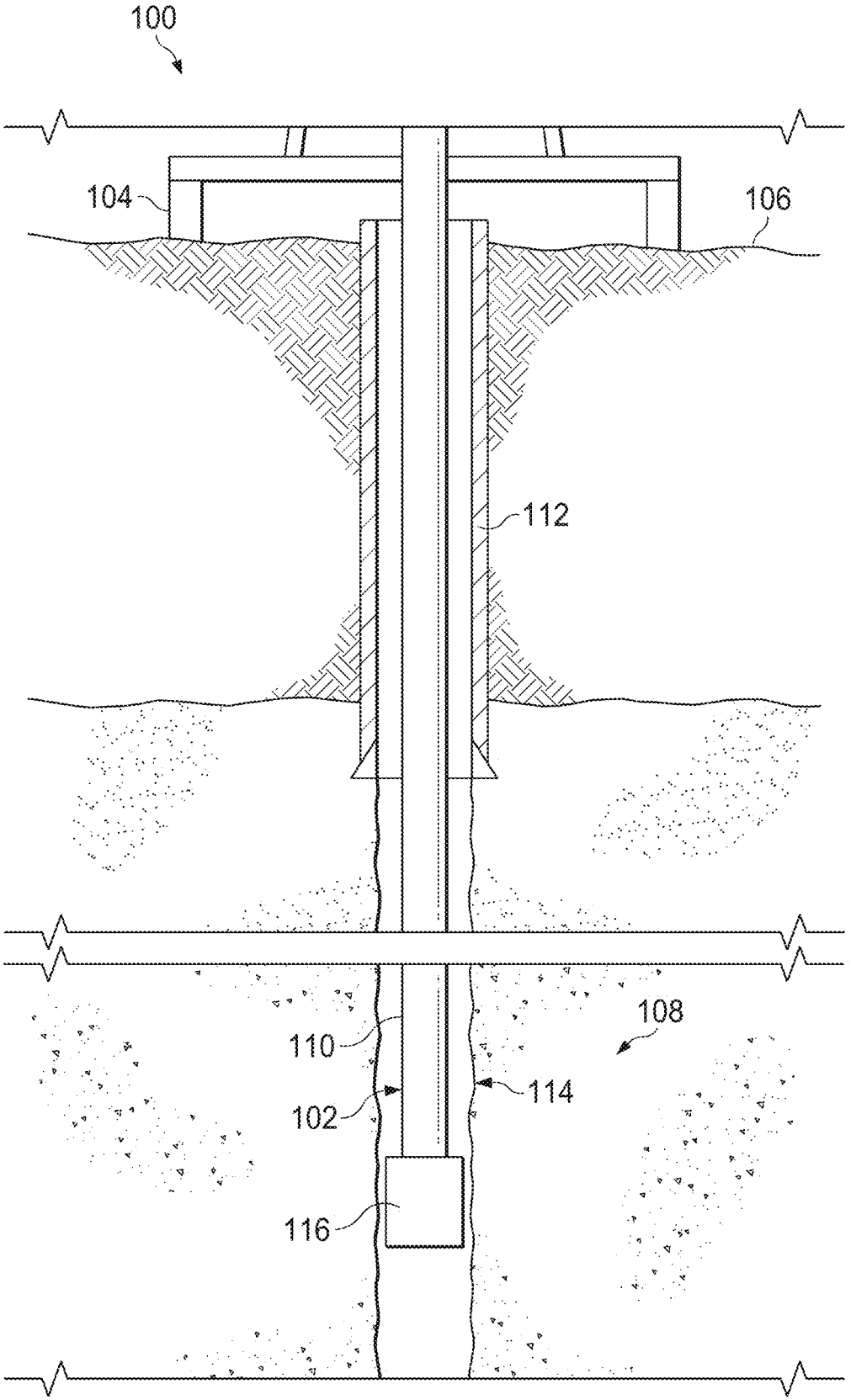
FIG. 1 is a schematic partial cross-sectional side view of an example well system.

This disclosure describes a downhole well system with a downhole-type well testing tool that isolates, treats, and tests select downhole zones within a wellbore in one run of the well testing tool. A downhole system including the well testing tool allows for communication of fluid, command signals, or both, between a surface location of the wellbore and the downhole-type well testing tool, and provides the ability to manipulate packers, valves, or other movable features of the well testing tool during testing of an evaluation zone of the wellbore. The well testing tool allows for pressure build-up testing, wellbore stimulation, and wellbore testing. The well testing tool can be run into a wellbore on a dedicated testing string, for example, between a drilling operation and a casing cementing operation. In some implementations, the well testing tool is carried on drill piping, casing tubing, or other tubing or piping. For example, the well testing tool run on drill pipes allows for a variety of coil tubing or wireline operations, such as fluid tubing displacement, fluid lift, emergency valve shifting operations through an inside diameter bore of the well testing tool, a combination of these, or other operations. In some examples, the well testing tool interacts with a communication module, such as smart coil tubing, coil tubing, slickline, or e-line, which is an electrical cable used to lower tools into and transmit data about the conditions of the wellbore called wireline logs. In some instances, e-lines include braided cables, and can be used to perform wireline logging. The communication module includes mounted transmitters and receivers, or a combination of these features to perform testing operations.

The well testing tool can operate in an open hole environment, a cased hole environment, or both, and includes open hole straddle packers that selectively engage with open hole sections, cased hole sections, or both open hole sections and cased hole sections of a wellbore. The straddle packers are deployed (for example, set) for testing operations, and retracted during movement of the drill string, such as during drilling. For example, the downhole-type well testing tool includes at least two retractable, multi-set packers spaced apart with a straddle tubing having a selectively operable ported extension at least partially between the retractable packers. The downhole-type well testing tool also includes one or more gauges (for example, pressure gauges or other gauges) and one or more valves, such as a flapper-type valve, ball valve, sleeve valve, or a combination of these types of valves, spaced above, between, and below the packers. In some implementations, the well testing tool measures various parameters of the flowing fluid in-situ and sends the data to a surface, or topside, facility in real time. The well testing tool is retractable, for example, such that the well testing tool can be indexed and set in a first zone to perform a first set of testing operations, then retracted and moved to a second zone to perform a second set of testing operations. In some examples, the well testing tool can be relocated and reengaged multiple times at different zones of interest of the wellbore in one run without requiring a pull out of hole (POOH) operation between testing operations.

The well testing tool can be activated, deactivated, or have its mode of operation altered in response to communication from a topside, surface facility. This communication can take a variety of forms of the communication module. For example, the communication can include acoustic telemetry, mud impulse telemetry, smart coil tubing, e-line, or fiber optic cable (or other cable) through the length of a tubing, a transmitter or receiver or both on a tubing and on the well testing tool, dropped ball or dart communication, radio frequency identification (RFID) tags passing by an RFID sensor on the well testing tool, a combination of these, or other forms of communication. In some implementations, the well testing tool can be activated, deactivated, or have its mode of operation altered in response to a pre-programmed testing sequence provided to the well testing tool by commands from a controller of a downhole logic tool incorporated into or otherwise coupled to the well testing tool.

FIG. 1 is a schematic partial cross-sectional view of an example well system 100 that includes a substantially cylindrical wellbore 102 extending from a well head 104 at a surface 106 downward into the Earth into one or more subterranean zones of interest 108 (one shown). The well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A well string 110 is shown as having been lowered from the surface 106 into the wellbore 102. In certain instances, after some or all of the wellbore 102 is drilled, a portion of the wellbore 102 is lined with lengths of tubing, called casing 112. The wellbore 102 can be drilled in stages, and the casing 112 may be installed between stages. The casing 112 can include a series of jointed lengths of tubing coupled together end-to-end or a continuous (for example, not jointed) coiled tubing. The casing 112 forms the cased section of the wellbore 102. In some examples, the well system 100 excludes casings, such as casing 112, and the wellbore 102 is at least partially or entirely open bore. The section(s) of the wellbore 102 exposed to the adjacent formation (for example, without casing or other permanent completion) form the open hole section 114 of the wellbore 102.

In the example well system 100 of FIG. 1, the well string 110 is a testing string 110 that includes a well testing tool 116 at a downhole end of the testing string 110. The well testing tool 116 is positioned in the wellbore 102 adjacent the open hole section 114 of the wellbore. The well testing tool 116 selectively performs active wellbore testing, and is rugged enough to withstand the harsh environment of the wellbore. In some implementations, the testing string 110 is made up at least partially of drill piping, where the well testing tool 116 couples to the drill piping. The well testing tool 116 can couple to the tubing of the testing string 110 with a threaded connection or other appropriate connection.

In some implementations, the well system 100 can include another type of well string 110 during another stage of well operation, where the well testing tool 116 is disposed on this other type of well string. For example, the well system 100 can include a production well, a well being drilled, a well being cased and cemented, a well being tested, or a well during other well operations, and can include a production string, a drill string, casing tubing, a testing string, or another type of well string. In some implementations, the well testing tool 116 is disposed on a drill string that also includes a bottom hole assembly (BHA) with a drill bit at a downhole end of the drill string, where the well testing tool 116 is positioned on the drill string uphole of the BHA. The well testing tool 116 is rugged enough to withstand the harsh wellbore environment and to be included on an active drill string.

The well testing tool 116 can be disposed at various locations on the well string 110. In some examples, the well testing tool 116 is disposed at a downhole end of the well string 110, directly above (for example, directly uphole of) a BHA of a well string, or disposed separate from and farther uphole of the downhole end of the well string 110, such as adjacent to the casing 112.

Figure 2:
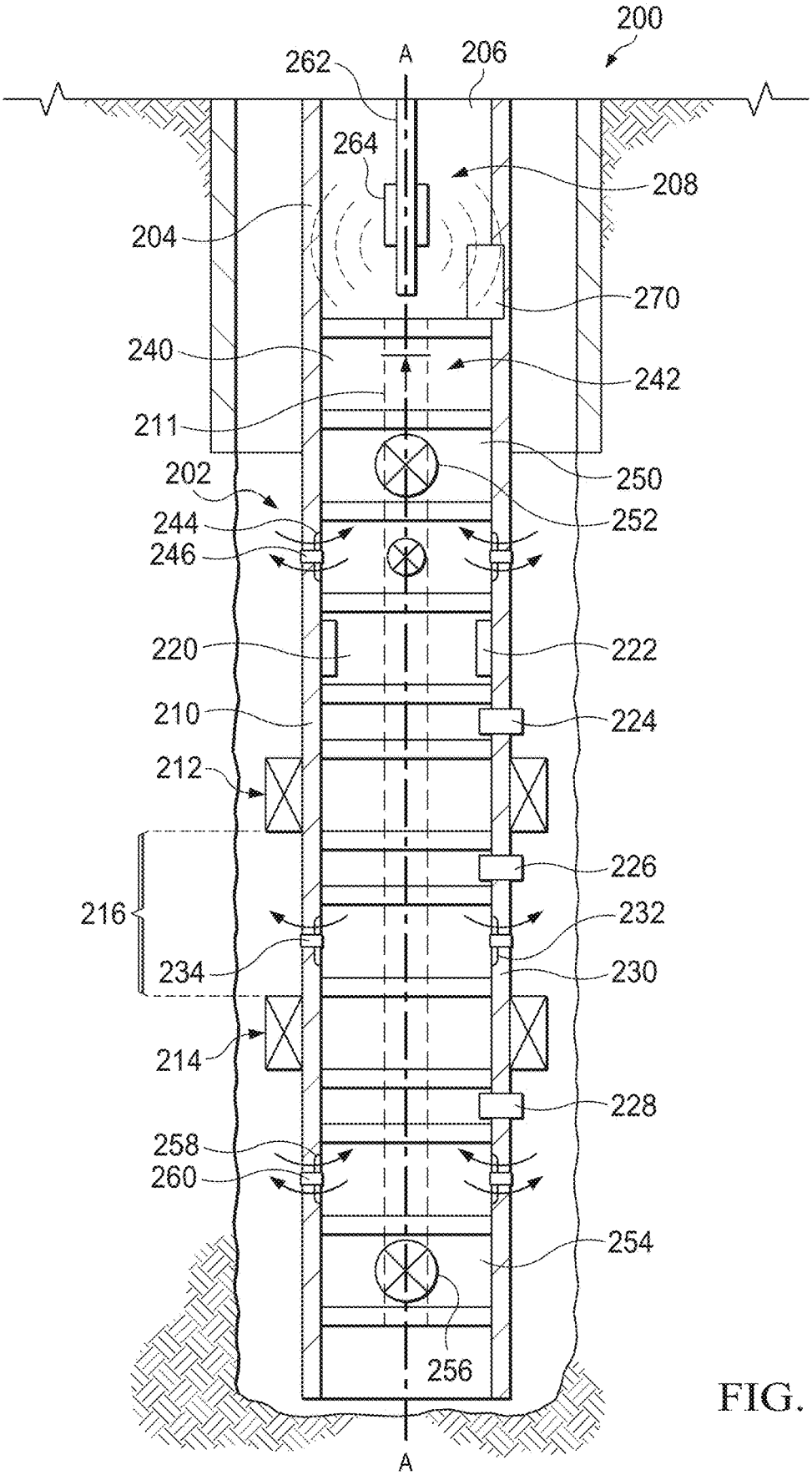
FIG. 2 is a schematic, partial cross-sectional side view of an example well testing system including a well testing tool that can be used in the example well system of FIG. 1.

FIG. 2 is a schematic, cross-sectional side view of an example well testing system 200 including a well testing tool 202, such as the well testing tool 116 of FIG. 1. The well testing system 200 can be used in the well system 100 of FIG. 1, for example, where the well testing tool 202 is disposed on the well string 110 of FIG. 1. The well testing system 200 includes the well testing tool 202 disposed on a testing string 204 (such as testing string 110 of FIG. 1) and within the wellbore 102 substantially along longitudinal axis A-A. The well testing tool 202 is positioned at least partially adjacent to an open hole section (for example, open hole section 114) of the wellbore 102 and adjacent to a zone of interest (for example, zone of interest 108) of the wellbore 102. The zone of interest can be a portion of the wellbore 102 adjacent a fluid-producing formation, where the well testing system 200 can isolate and test all or a portion of the zone of interest. The example well testing system 200 of FIG. 2 also shows a portion of the casing 112 of the wellbore 102, and the well testing tool 202 is shown as adjacent to the open hole section 114 of the wellbore 102. However, in some implementations, the well testing tool 202 can operate in the wellbore 102 adjacent the open hole portion 114, adjacent the casing 112, adjacent to another section of the wellbore 102, or a combination of these sections of the wellbore 102.

The well testing tool 202 includes a generally cylindrical housing 210 positioned about longitudinal axis A-A, with a central bore 211 extending from an upper longitudinal end of the housing 210 to a lower, opposite longitudinal end of the housing 210. The cylindrical housing 210 connects at an uphole end of the housing 210 to piping or tubing of the testing string 204, which extends from the well testing tool 202 to surface equipment at topside of the wellbore 102. The testing string 204 allows communication of fluid through a central bore 206 of the testing string 204, and in some implementations, allows for lowering of a coil tubing, wireline, communication device, a combination of these, or other components through the central bore 206 (and the central bore of the housing 210). In the example testing assembly 200 of FIG. 2, a communication module 208 in the form of a smart coil tubing 262 is shown as having been lowered through the testing string 204 to the well testing tool 202. The communication module 208 is described in more detail later.

The testing tool 202 includes a number of components attached to the housing 210 and fluid ports through the housing 210 that allow the testing tool 202 to be set, to flow and communicate fluids, and measure and test fluids, described in more detail later. The multiple components can be coupled to or integrally formed in the housing 210. For example, one or more or all of the components of the testing tool 202 can threadedly couple (in other words, couple via threading) to a component directly uphole of, directly downhole of, or both directly uphole of or directly downhole of the respective component. In these examples, threads can be present between each valve component to connect each valve component, or can be integrated with other valve components, sensors, or both. In certain examples, one or more of the components of the testing tool 202 can be integrally formed in the housing 210, in that the housing 210 can form a portion of or all of a structure of the respective component. In the example well testing system 200 of FIG. 2, the well testing tool 202 includes a first, upper packer 212 and a second, lower packer 214, each positioned about the housing 210 and substantially circumscribing portions of the housing 210. The first, upper packer 212 is positioned longitudinally uphole of the second, lower packer 214 along the housing 210. The longitudinal length between the first packer 212 and the second packer 214 can vary. In some examples, the first packer 212 and second packer 214 are spaced apart a length between twelve feet and two hundred feet, such as fifty feet between the first packer 212 and the second packer 214.

The first, upper packer 212 and the second, lower packer 214 can selectively expand and contract radially to selectively engage and seal against the wall of the wellbore 102. With the first packer 212 and the second packer 214 in the radially expanded position engaged with the wall of the wellbore 102, the packers 212 and 214 isolate a wellbore zone between the first packer 212 and the second packer 214, which defines an isolated zone of interest 216. Each of the first packer 212 and the second packer 214 includes a sealing element that circumscribes at least a portion of the housing 210. The sealing element radially expands to engage and seal (substantially or completely) against the inner wall of the wellbore 102 when activated. The sealing element, when engaged against the inner wall of the wellbore 102, separates the annulus of the wellbore 102 into separate annular sections. Such sealing restricts fluids and gasses from passing from one annular side of the sealing element to the other annular side. The sealing element of the first packer 212 and second packer 214 can take many forms. For example, the sealing element can include an inflatable packer element, a mechanical packer, a swellable packer, or another type of packer element to seal against the inner wall of the wellbore 102.

In some implementations, the testing tool 202 can include a third packer, a fourth packer, or both a third packer and a fourth packer in close proximity to the first packer 212 and the second packer 214. These additional packers can act as supplemental or replacement packers in the event that the first packer 212, second packer 214, or both the first packer 212 and second packer 214 are faulty or fail. In some embodiments, a sleeve valve (similar to straddle tubing 230, described later) between the primary packers (first packer 212 and second packer 214) and backup packers (third packer and fourth packer) can control the annulus between packers. For example, a first backup sleeve valve between the first packer 212 and the third packer (positioned uphole of the first packer 212) can selectively flow fluid between the central bore and the annulus between the first packer 212 and the third packer. Similarly, a second backup sleeve valve between the second packer 214 and the fourth packer (positioned downhole of the second packer 214) can selectively flow fluid between the central bore and the annulus between the second packer 214 and the fourth packer.

The first packer 212 and the second packer 214, and optionally the third packer and fourth packer, are retractable, and can be activated and deactivated multiple times throughout a testing operation. In some implementations, the well testing tool 202 includes a packer set up tool 220 to activate, set, and deactivate the packers of the well testing tool 202. The packer set up tool 220 includes an activation mandrel 222 connected to the packers of the testing tool 202 to selectively set and unset the packers, such as first packer 212 and second packer 214. In certain implementations, the packer set up tool 220 can be excluded from the well testing tool 202, and each packer of the well testing tool 202 can include its own mechanism for setting and unsetting the sealing element of the packers.

The packers (for example, first packer 212, second packer 214, third packer, fourth packer, or a combination of these packers) can take a variety of forms and be activated in a variety of ways. For example, the packer can be an inflatable packer or a mechanical packer, and include an inflatable seal element or a compressible seal element that engage with and seal against the wall of the wellbore 102. The packer can have a built-in battery and an electromechanical motor to drive a shifting mechanism that activates and sets (or deactivates and unsets) the seal element of the packer, for example, in response to a signal from the communication module 208. In some implementations, tubing manipulation, such as moving the tubing upward or downwards, rotating, jarring, or a combination of such tubing manipulation of the testing string 204, can act to set or unset the packers.

One or more sensors are positioned above, between, and below the first packer 212 and the second packer 214. In the example well testing system 200 of FIG. 2, the well testing tool 202 includes a first pressure sensor 224 positioned on the cylindrical housing 210 uphole of the first packer 212, a second pressure sensor 226 positioned on the cylindrical housing 210 between the first packer 212 and the second packer 214, and a third pressure sensor 228 positioned downhole of the second packer 214. The pressure sensors 224, 226, and 228 monitor a pressure in the annulus between the housing 210 and the wall of the wellbore 102 during testing operations. The pressure sensors 224, 226, and 228 are configured to measure pressure in the annulus adjacent to the respective pressure sensor, but can be configured to also (or instead) measure pressure within the housing 210 of the well testing tool 202. In some implementations, the well testing tool 202 can include additional sensors, different types of sensors, or a combination of more and different sensors. For example, the well testing tool 202 can include additional pressure sensors, include one or more temperature sensors, include one or more flow meters, a combination of these, or include other types of sensors. The sensors of the well testing tool 202, such as pressure sensors 224, 226, and 228, can be powered locally by a battery encased in the well testing tool 202, a downhole power generator, wirelessly charged using smart coil or e-line (for example, by induction), a dedicated power line extending from the surface to the well testing tool 202, other power supplies, or a combination of these power supplies. In general, sensors that are useful for in situ well testing can also be included in the well testing tool 202.

The well testing tool 202 includes a straddle tubing 230 positioned between the first, upper packer 212 and the second, lower packer 214. The straddle tubing 230 forms a section of the cylindrical housing 210 between the first packer 212 and second packer 214, and can be made up of one or multiple tubing sections extending along the longitudinal axis A-A along a portion of or the entire length between the packers 212 and 214. The tubing section(s) of the straddle tubing 230 includes a sliding sleeve 232 and one or more straddle communication ports 234 (two shown in FIG. 2). The sliding sleeve 232 selectively covers and uncovers the straddle communication ports 234 that fluidly connect the annulus of the wellbore 102 adjacent the straddle tubing 230 with the central bore 206 of the well testing tool 202 adjacent the straddle tubing 230. In some examples, the sliding sleeve 232 includes an inner mandrel slidably connected to a radially inner surface of the tubing of the straddle tubing 230, where the inner mandrel is configured to longitudinally slide to a first, closed position to block and plug the straddle communication ports 234, and to longitudinally slide to a second, open position to unplug and open the straddle communication ports 234. The sliding sleeve 232 can be formed in the tubing section(s) of the straddle tubing 230, and actuated by an actuation mechanism attached to the sliding sleeve 232. The actuation mechanism can take many forms. In some examples, the actuation mechanism includes a mechanical-type actuator (for example, a linear actuator, rotary actuator, or hydraulic actuator), includes a ball seat configured to engage with a dropped ball or dart from the surface to effect movement of the sliding sleeve 232, or includes other actuator types.

In some examples, such as in the straddle tubing 230 described earlier or in other components with a sliding sleeve and a radial port, one or more ported holes are spaced radially in a housing, with seals on one or both sides of the ported holes, preferably in the housing (in other words, not on the sleeve). In some instances, the seal can be positioned on either or both of the housing or the sleeve. In instances when the port is closed, the sleeve covers the port(s) with both seals engaged, and during opening of the port(s), the sleeve moves longitudinally to uncover the port(s) in the housing. In some instances, a seal in the housing will stay engaged with the sliding sleeve, and another seal can be uncovered after completing actuation of the sleeve. In certain instances, the sleeve can include a sleeve port through the sleeve itself, where the sleeve port is configured to align with the radial port in an open position of the sleeve, and configured to not align with the radial port in a closed position of the sleeve. For example, the sleeve port can be covered with a portion of the housing (to protect the seal) in the closed position, and in such cases, the sleeve ports are configured to move across the housing to align with the radial port(s) upon sliding actuation of the sleeve. In some instances, the sleeve(s) can be spring loaded, for example, to bias the sleeve back toward the closed position.

The well testing tool 202 further includes a number of valves disposed throughout the cylindrical housing 210 of the well testing tool 202, including locations above, between, and below the first packer 212 and the second packer 214. The valves are actuated and controlled during the testing operations according to a predetermined testing sequence or a communication module (for example, communication module 208), described in greater detail later. The valves can be radial valves (for example, to selectively plug or flow fluid between the central bore of the well testing tool 202 and the annulus adjacent to the valve) or longitudinal valves (for example, to selectively plug or flow fluid along the central bore of the well testing tool 202). In some examples, one or more or all of the valves of the well testing tool include an actuation mechanism to control a position of the valve between an open or closed position. The actuation mechanism can take many forms. For example, the actuation mechanism can include an electromechanical actuator coupled to a shifting mechanism configured to drive one or more valves. In some instances, actuators can be hydraulic (using fluid pressure to change valves and packers states), pneumatic (using gas), electric (using energy from a battery or other power source to drive the system through different states), or mechanical (converting rotation into longitudinal motion or longitudinal motion into a changing valve position). In some examples, the well testing tool 202 incorporates electrical actuators hydraulic actuators, or both, and in some instances, mechanical actuators, pneumatic actuators, or both can be used.

The example well testing tool 202 of FIG. 2 includes a pressure test valve 240 mounted to (or forming part of) the housing 210 and positioned longitudinally uphole of the first packer 212. The pressure test valve 240 selectively closes and seals the central bore 206 uphole of the first packer 212 in one longitudinal direction or both uphole and downhole longitudinal directions. In some implementations, the pressure test valve 240 includes a one-directional valve 242, such as a flapper-type valve or other one-way valve types, selectively sealing the central bore 206 at the location of the pressure test valve 240. The one-directional valve 242 can plug the central bore 206 at the pressure test valve 240 to restrict fluid from flowing downhole, and open the central bore 206 at the pressure test valve 240 to allow fluid to flow uphole. The one-directional valve 242 can take a variety of forms, such as a flapper-type valve, ball valve, diaphragm valve, tilting disc valve, a lift-check valve, a combination of these, or another type of one-way valve. The one-directional valve 242 can also be actuated to an open position or a closed position, for example, to maintain the one-directional valve 242 in an open or closed position regardless of the direction of fluid flow in the central bore 206. In some examples, the pressure test valve 240 includes a spring mechanism connected to the one-directional valve 242 and pre-loaded by a shear pin or fuse. When prompted by a communication module (for example, communication module 208) or other device, the fuse or shear pin breaks, and the pre-loaded spring is released. The spring can act on the one-directional valve 242, for example, to hold the one-directional valve 242 in an open position. The pressure test valve 240 can also be actuated in other ways.

The example well testing tool 202 of FIG. 2 also includes a mud displacement valve 244 mounted to (or forming part of) the housing 210 and positioned longitudinally uphole of the first packer 212 between the first packer 212 and the pressure test valve 240. The mud displacement valve 244 includes one or more communication ports 246 (two shown in FIG. 2) between the central bore 206 and the annulus between the housing 210 and the wall of the wellbore 102 adjacent to the mud displacement valve 244. The communication ports 246 of the mud displacement valve 244 allow selective communication of fluid between the central bore 206 and the annulus. The mud displacement valve 244 can include a sliding sleeve, a valve covering the communication ports 246, or other plug structures that can actuate to plug and seal or to unplug and open the communication ports 246 to fluid flow.

The example well testing tool 202 of FIG. 2 also includes a first, upper shut-in valve 250 and a second, lower shut-in valve 254. The first, upper shut-in valve 250 is mounted to (or forms part of) the housing 210 and is positioned longitudinally uphole of the first packer 212, for example, between the first packer 212 and the pressure test valve 240, and uphole of the mud displacement valve 244. The first shut-in valve 250 selectively closes and seals the central bore 206, for example, with a first ball valve 252 configured to selectively open and close the central bore 206 to fluid flow. The second, lower shut-in valve 254 is mounted to (or forms part of) the housing 210 and is positioned longitudinally downhole of the second packer 214, for example, downhole of the third pressure sensor 228. The second shut-in valve 254 selectively closes and seals the central bore 206, for example, with a second ball valve 256 configured to selectively open and close the central bore 206 to fluid flow.

In some implementations, the example well testing tool 202 can include one or more backup valves disposed along the cylindrical housing 210 and including one or more fluid communication ports that selectively open and close to allow fluid flow between the annulus of the wellbore 102 and the central bore 206. For example, the well testing tool 202 includes a first, lower backup valve 258 mounted to or forming part of the housing 210 and positioned longitudinally downhole of the second, lower packer 214. The first backup valve 258 is shown positioned between the third pressure sensor 228 and the second, lower shut-in valve 254. Similar to the structure of the mud displacement valve 244, the first backup valve 258 includes one or more communication ports 260 (two shown in FIG. 2) between the central bore 206 and the annulus between the housing 210 and the wall of the wellbore 102 adjacent to the first backup valve 258. The communication ports 260 of the first backup valve 258 allow selective communication of fluid between the central bore 206 and the annulus. The first backup valve 258 can include a sliding sleeve, a valve covering the communication ports 260, or other plug structures that can actuate to plug and seal or to unplug and open the communication ports 260 to fluid flow. In some instances, the well testing tool 202 can include a second, upper backup valve (not shown) similar in structure to the first, lower backup valve 258, but positioned elsewhere along the housing 210, such as directly uphole of the first, upper shut-in valve 250. In some examples, the second, upper backup valve provides redundancy or backup functionality to the well testing tool 202, where the valve opening of the second, upper backup valve is left closed during operation, and actuated open only when the mud displacement valve 244 or first, upper shut-in valve 250 fail to operate.

The well testing tool 202 interacts with the communication module 208 to prompt actuation of the components (for example, the first packer 212, second packer 214, first pressure sensor 224, second pressure sensor 226, third pressure sensor 228, sliding sleeve 232 of the straddle tubing 230, pressure test valve 240, mud displacement valve 244, first shut-in valve 250, second shut-in valve 254, and first backup valve 258) of the well testing tool 202, and to initiate and control testing operations performed by the well testing tool 202. For example, the well testing tool 202 can include a receiver communicably coupled to the components of the well testing tool 202 to read and distribute signals from the communication module 208 to the respective components of the well testing tool 202. In some implementations, the well testing tool 202 operates in response to commands sent from a tophole surface location, such as from a well operator at a tophole control facility, via the communication module 208. The communication module 208 communicates with one or more components of the well testing tool 202 to change a status of the one or more components.

In the example well testing system 200 of FIG. 2, the communication module 208 includes smart coil tubing 262, which is a coil tubing that incorporates a fiber optic cable or other type of communication cable through the entire length of the coil tubing, and a transmitter and receiver 264 at a downhole end of the coil tubing. The transmitter and receiver 264 is coupled to the fiber optic cable (or other cable) to allow signal transmission and reception between a tophole facility at the surface and the well testing tool 202. The smart coil tubing 262 includes a transmitter and receiver 264, which send and receive signals to and from the well testing tool 202 during operation of the well testing tool 202. The well testing tool 202 can include a primary transmitter and receiver that communicates with the transmitter and receiver 264 of the smart coil tubing 262, or one or more or all of the components of the well testing tool 202 can include its own transmitter and receiver to communicate with the smart coil tubing 262.

The communication module 208 can take many forms, for example, depending on the type of communication and control being implemented between a tophole surface location and the well testing tool 202. For example, communication between the tophole surface location and the well testing tool 202 can include telemetric communication, wireline communication, wired communication over cables, wireless communication with receivers and transmitters, drop plug communication, a combination of these, or other modes of communication. In some implementations, the communication module 208 includes smart coil tubing, wireline, slickline, or e-line tubing, fiber optic cable (or other cable) through the length of a tubing, a transmitter or receiver or both on a tubing and on the well testing tool, dropped plug communication such as a dropped ball or dart, RFID tags passing by one or more RFID sensors on the well testing tool 202, acoustic telemetry communication, mud impulse telemetry, a combination of these, or other forms of communication. The well testing tool 202 incorporates communication devices that complement the type of communication implemented by the communication module 208. For example, one or more of the components of the well testing tool 202 can include its own acoustic transmitter or receiver, or two or more of the components can connect to a main acoustic transmitter or receiver to communicate with the surface. In some examples, one or more of the components of the well testing tool 202 includes its own RFID sensor configured to receive and interpret signals from corresponding RFID tags dropped from the surface to the well testing tool 202, or two or more or all of the components connect to a primary RFID sensor configured to receive and interpret signals from corresponding RFID tags dropped from the surface to the well testing tool 202 and send corresponding signals to a respective component of the well testing tool 202. In certain examples, a coil tubing or wireline can include one or more RFID tags configured to communicate with the corresponding RFID sensor(s) of the well testing tool 202. In certain implementations, the coil tubing or wireline can include an antenna or sensor, such as an RFID sensor, to receive signals from components of the well testing tool 202, such as the pressure sensors 224, 226, and 228, and transmit the received signal to the surface. In some implementations, instead of RFID sensors and receivers, the coil tubing or wireline can include acoustic receivers, and signal(s) can be sent from a surface location of the well with the aid of acoustic repeaters, or instead of repeaters, an acoustic receiver and transmitter can be mounted on smart coil and communicate to one main receiver/transmitter or to each component of the well testing tool 202 separately if the respective component includes its own receiver(s)/transmitter(s).

In some implementations, the well testing tool 202 includes a controller 270 connected to the components of the well testing tool 202 to allow for a pre-programmed testing sequence of the well testing tool 202 as the well testing tool 202 is disposed downhole in the wellbore 102. The controller 270 forms at least part of a downhole logic tool coupled to or integral with the well testing tool 202, and communicatively coupled (for example, with a wired connection or wireless connection) to the components of the well testing tool 202 to provide actuation instructions as part of a pre-programmed sequence of operations of the well testing tool 202. The downhole logic tool with the controller 270 can be included in the well testing tool 202 in addition to or instead of the communication module 208, for example, to actuate the components of the well testing tool 202 during a testing operation. The downhole logic tool can include interlocks, for example, to reduce out-of-sequence actuation of one or more valves or packers during a testing operation. The downhole logic tool, for example, including the interlocks, can minimize human error and increase operation safety of the well testing tool 202. In some examples, if a differential pressure across the first packer 212, second packer 214, or another packer is measured with a pressure gauge (such as gauge 224, 226, or 228) and it is greater than a set value, such as 500 pounds per square inch (psi), then an instruction to deactivate the respective packer can be overruled (in other words, the packer will not deactivate, or disengage, from the wall) if the button for packer deactivation is pressed, for example, unless it is further confirmed that the deactivation of the respective packer is intentional even with the substantial differential pressure across the sealing elements. In another example, valve and packer operations can be grouped into stages: in an exemplary first stage of operation, an exemplary second stage of operation, and an exemplary third stage of operation. In each of these three stages, preprogrammed sequencing can occur according to certain requirements of operation. For example, in some embodiments of Stage 1: pressure test valve 240 is locked open, all other valves component inner diameters are checked open, the first packer 212 and the second packer 214 are set, and the port of the lower shut in valve 254 is closed. In Stage 2: the straddle communication port 234 of the straddle tubing 230 is opened. In Stage 3: the straddle communication port 234 of the straddle tubing 230 is closed, the lower shut in valve 254 is opened, and the upper shut in valve 250 is opened.

Figure 3:
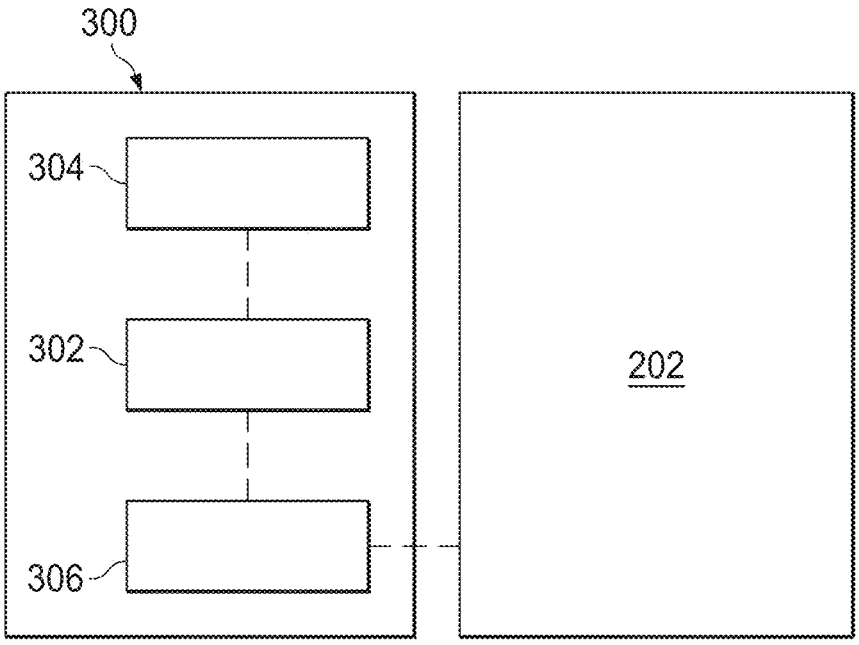
FIG. 3 is a block diagram of a controller that can be used in the example well testing tool of FIG. 2.

For example, FIG. 3 is a block diagram of a controller 300 that can be used with aspects of the well testing tool 202 of FIG. 2. For example, the controller 300 can be used in the controller 270 of the downhole logic tool of the well testing tool 202 of FIG. 2. The controller 300 can include one or more processors 302 and non-transitory memory 304 including instructions to facilitate sending and receiving signals through an input/output (I/O) interface 306. The controller 300 can communicate with components of the well testing tool 202 such as, for example, the upper packer 212 and lower packer 214, one or more of the pressure sensors 224, 226, and 228, the pressure test valve 240, the straddle tubing 230, the mud displacement valve 244, the upper shut-in valve 250 and the lower shut-in valve 254, the backup valves, other components of the well testing tool 202, or a combination of these components. In some implementations, the controller 300 is located entirely downhole within the well testing tool 202, entirely at a topside facility, or a combination of downhole and topside locations. For example, the controller 300 can be a distributed controller, where a portion of the controller 300 is located within the well testing tool 202, while another portion of the controller 300 is located elsewhere at a surface of the well.

The present disclosure is also directed to a method of monitoring, controlling, and using the well testing tool 202. To monitor and control the well testing tool 202, the controller 300 is used in conjunction with the one or more sensors to measure parameters of the production fluid and the downhole-type well testing tool 202 at various positions within the wellbore 102 during testing operations. Input and output signals, including the data from the sensors, can be controlled by the controller 300, can be logged continuously by the controller 300, stored in a memory 304 coupled to the controller 300, output to a receiver locally downhole or elsewhere, or a combination of these. The input and output signals can be logged at a rate specified by the operator of the well testing tool 202. The controller 300 can also be used to operate and control motors, pumps, valves, flow control devices, or other components associated with the well testing tool 202. Further, the controller 300 can be used with the well testing tool 202 to operate the well testing tool 202. The memory 304 can store programming instructions for execution by the one or more processors 302. For example, the processors 302 can execute programming instructions to run a predetermined, pre-programmed sequence of testing operations. In some instances, the processors 302 can execute instructions to detect a signal, for example, from a transmitter on a coil tubing (for example, smart coil tubing 262), from an RFID tag, or from other sources. The processors 302 can execute programming instructions to activate or deactivate the components of the well testing tool 202.

Figure 4A:
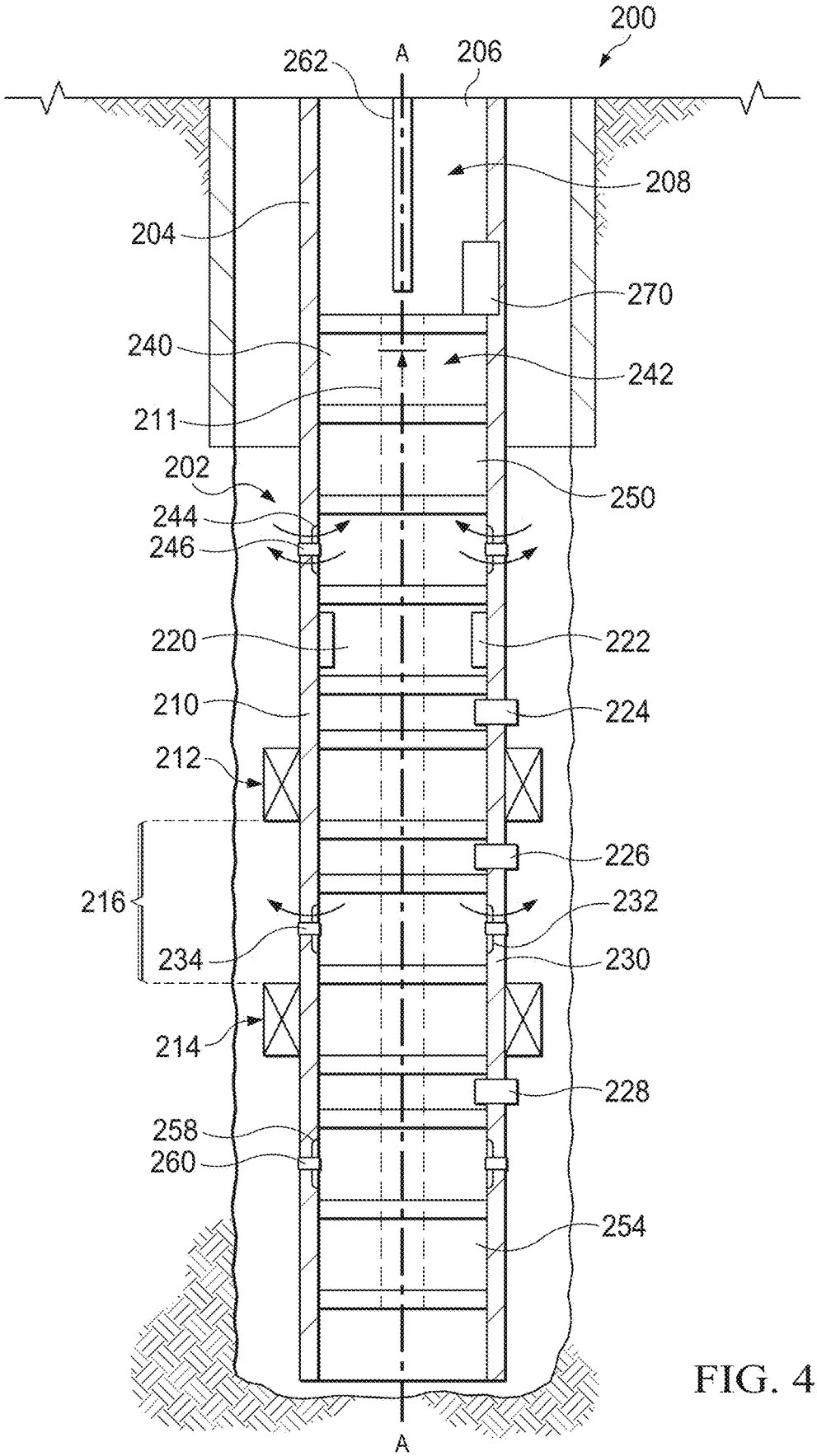
FIGS. 4A to 4J are schematic, partial cross-sectional side views of an example well testing system including the well testing tool of FIG. 2.

FIGS. 4A-4J are schematic, cross-sectional side views of the example well testing system 200 with the well testing tool 202 in the wellbore 102. FIGS. 4A-4J illustrate an example sequence of operations for a testing operation of the well testing tool 202. In FIG. 4A, the well testing tool 202 is run in the wellbore 102 on the testing string 110, and fluid is circulated downhole through the annulus to a downhole end of the well testing tool 202, then uphole through the well testing tool 202. As the well testing tool 202 is run in hole, the pressure test valve 240 is kept open to allow fluid flow uphole through the central bore 206 of the well testing tool 202. The well testing tool 202 can be stopped at a predetermined depth of the wellbore 102 or at desired intervals to pressure test the integrity of the cylindrical housing 210, for example, by closing the pressure test valve 240 and applying direct circulation of fluid into the testing string 110. During a pressure test, as shown in FIG. 4A, the pressure test valve 240 is closed, the mud displacement valve 244 is closed, the first packer 212 and the second packer 214 are retracted, the straddle tubing 230 is closed, the first backup valve 258 is closed, and the first shut-in valve 250 and the second shut-in valve 254 are open. The well testing tool 202 is run in hole to a targeted depth (TD), for example, starting from a lowest zone of interest. After completing testing and stimulation operations, the well testing tool 202 can be moved uphole to test and stimulate longitudinally uphole zones of interest of the wellbore 102.

Figure 4B:
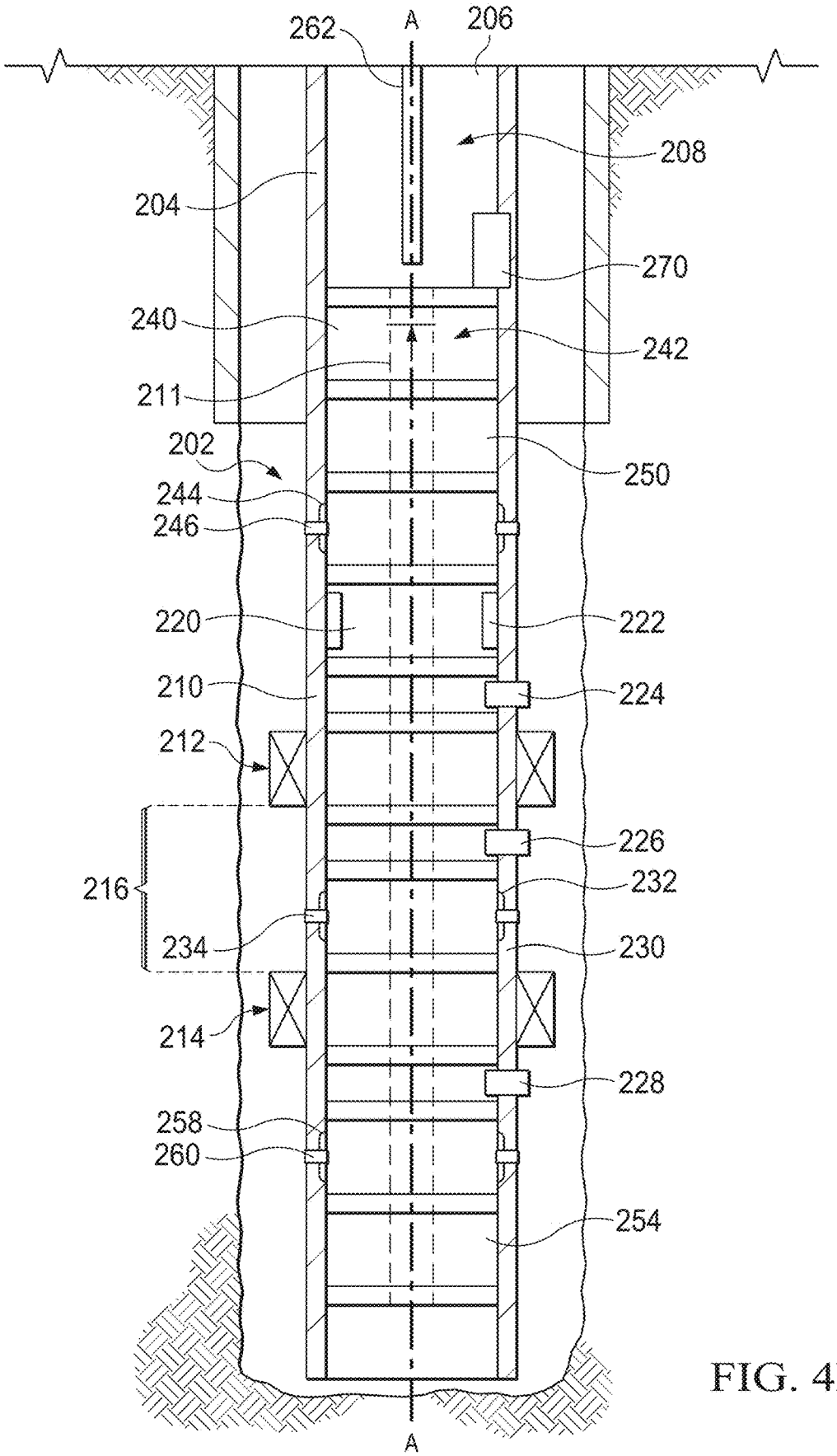

In FIG. 4B, the testing string 110 is drift tested down to the pressure test valve 240, for example, to confirm that the communication module 208, such as a coil tubing or wireline, can pass freely through the testing string 110 for later stages of the testing operation. In some implementations, the communication module 208 includes the smart coil tubing 262 including a transmitter and receiver 264, and the drift test includes testing the communication between the transmitter and receiver 264 with the one or more transmitters and receivers of the well testing tool 202. In certain implementations, the communication module 208 includes a wireline or coil tubing fitted with repeaters spaced intermittently along the length of the wireline or coil tubing, for example, to effect communication between the surface and the well testing tool 202.

Figure 4C:
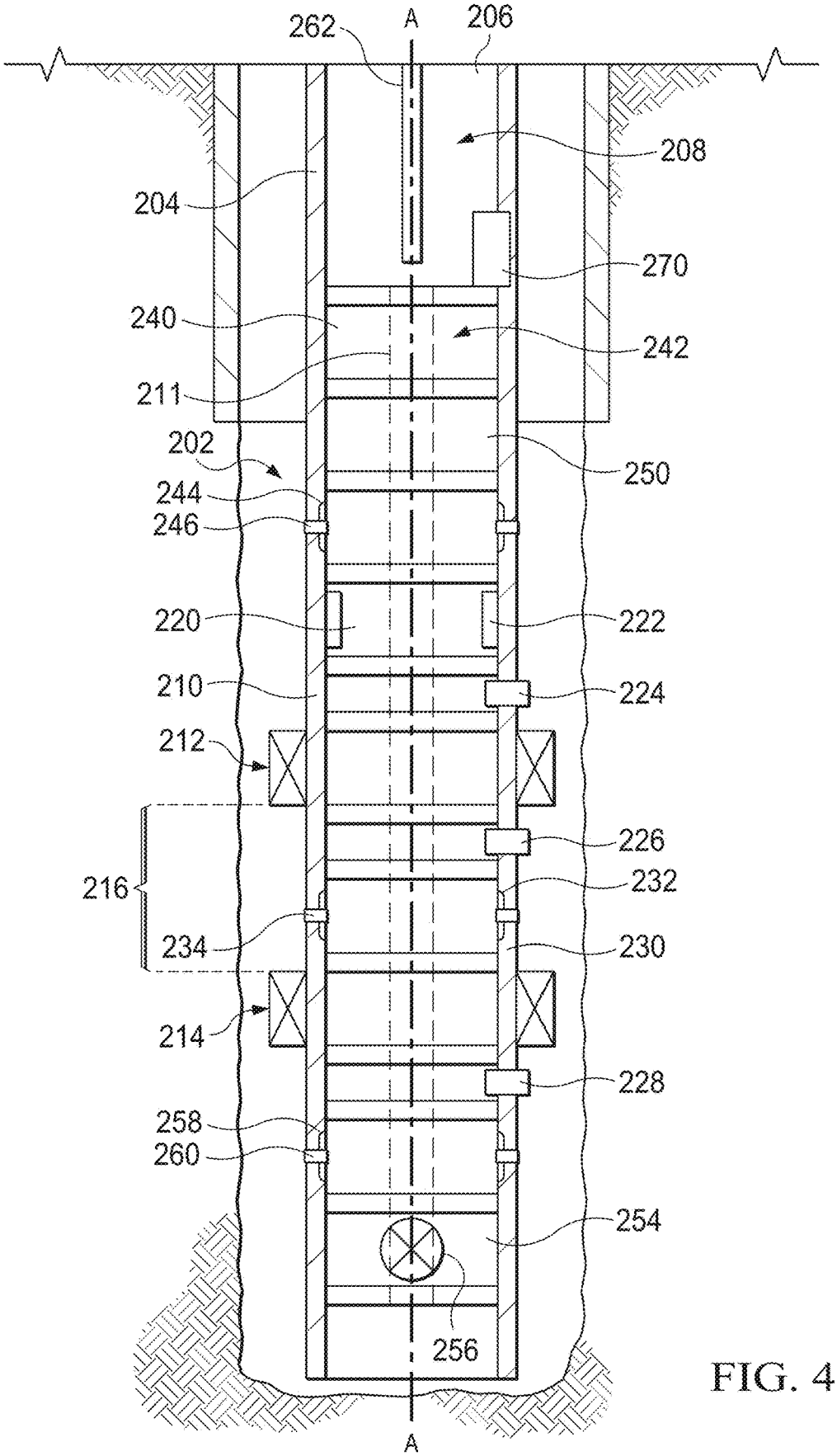
Figure 4D:
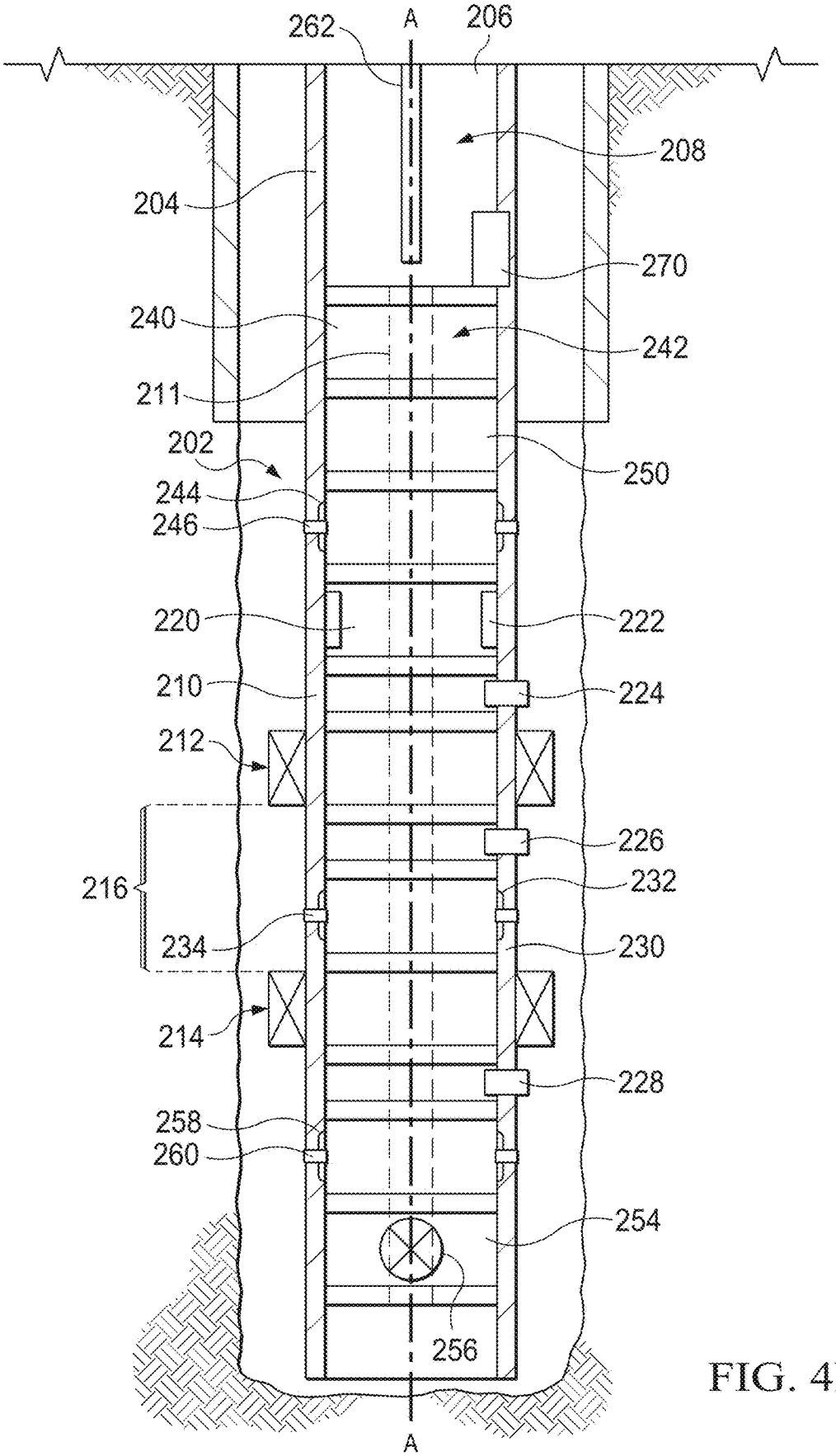

In FIG. 4C, the well testing tool 202 is pressure tested by opening the pressure test valve 240 and closing the second shut-in valve 254, for example, to confirm the pressure test valve 240 opened, to confirm pressure integrity of the system at depth after running in, and to confirm the second shut-in valve 254 closes and seals effectively. In FIG. 4D, one or both of the upper packer 212 and lower packer 214 are activated and set in the wellbore 102, for example, at a first targeted depth interval of the wellbore 102. The upper packer 212 and lower packer 214 can be set, simultaneously or sequentially, to engage and seal against the inner wellbore wall of the wellbore 102. In some implementations, activating and setting the upper packer 212 and lower packer 214 includes activating the packer set up tool 220 and its respective activation mandrel 222 to set the first packer 212, the second packer 214, or both packers 212 and 214. Setting the packers 212 and 214 defines the isolated zone of interest 216 between the first packer 212 and the second packer 214.

Figure 4E:
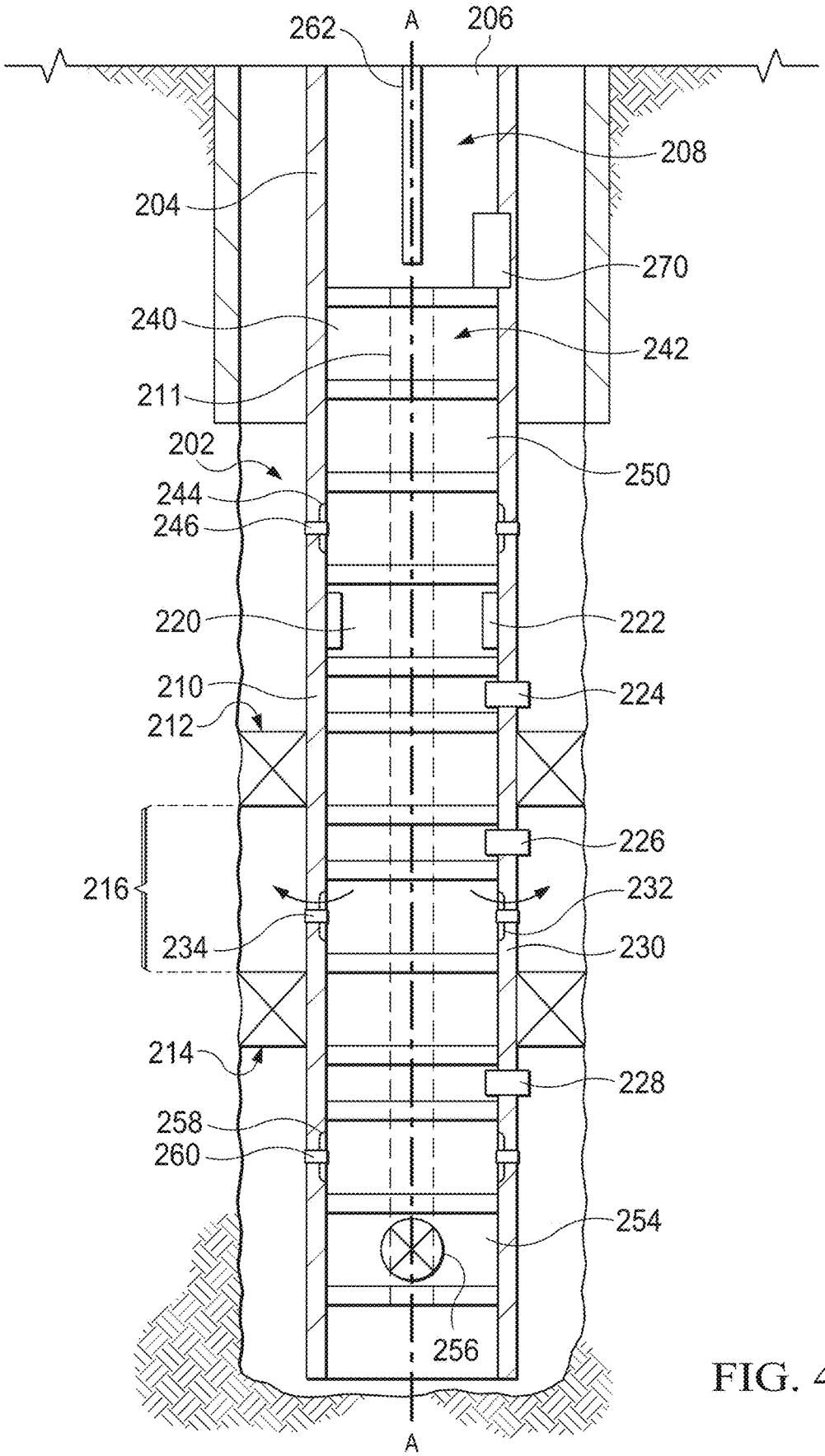

In some implementations, such as depicted in FIG. 4E, the upper packer 212 and lower packer 214 are pressure tested to ensure sufficient sealing of the respective packers to the wellbore wall, for example, to ensure sufficient isolation of the zone of interest 216 between the respective packers. For example, in FIG. 4E, the sliding sleeve 232 of the straddle tubing 230 is activated to open the straddle communication port(s) 234, the testing string 204 is pressurized, the fluid pressure in the central bore 206 of the well testing tool 202 acts against the first packer 212 and second packer 214, and the pressure in the annulus and the testing string 204 are measured to determine if the packers 212 and 214 provide sufficient sealing. In some implementations, the lower packer 214 is set and pressure tested before the upper packer 212 is set and pressure tested. For example, the lower packer 214 can be set, the lower backup valve 258 is opened to allow fluid flow radially outward to the annulus, and an operator attempts to direct circulate fluid to ensure the lower packer 214 is sealingly engaged with the wellbore wall. After the pressure test, the lower backup valve 258 can be closed. After the pressure test of the lower packer 214, the upper packer can be set, the straddle communication port(s) 234 is opened, and an operator attempts to directly circulate fluid to ensure the upper packer 212 is sealingly engaged with the wellbore wall. After the pressure test of the upper packer 212, the straddle communication port(s) 234 of the straddle tubing 230 can be closed.

Figure 4F:
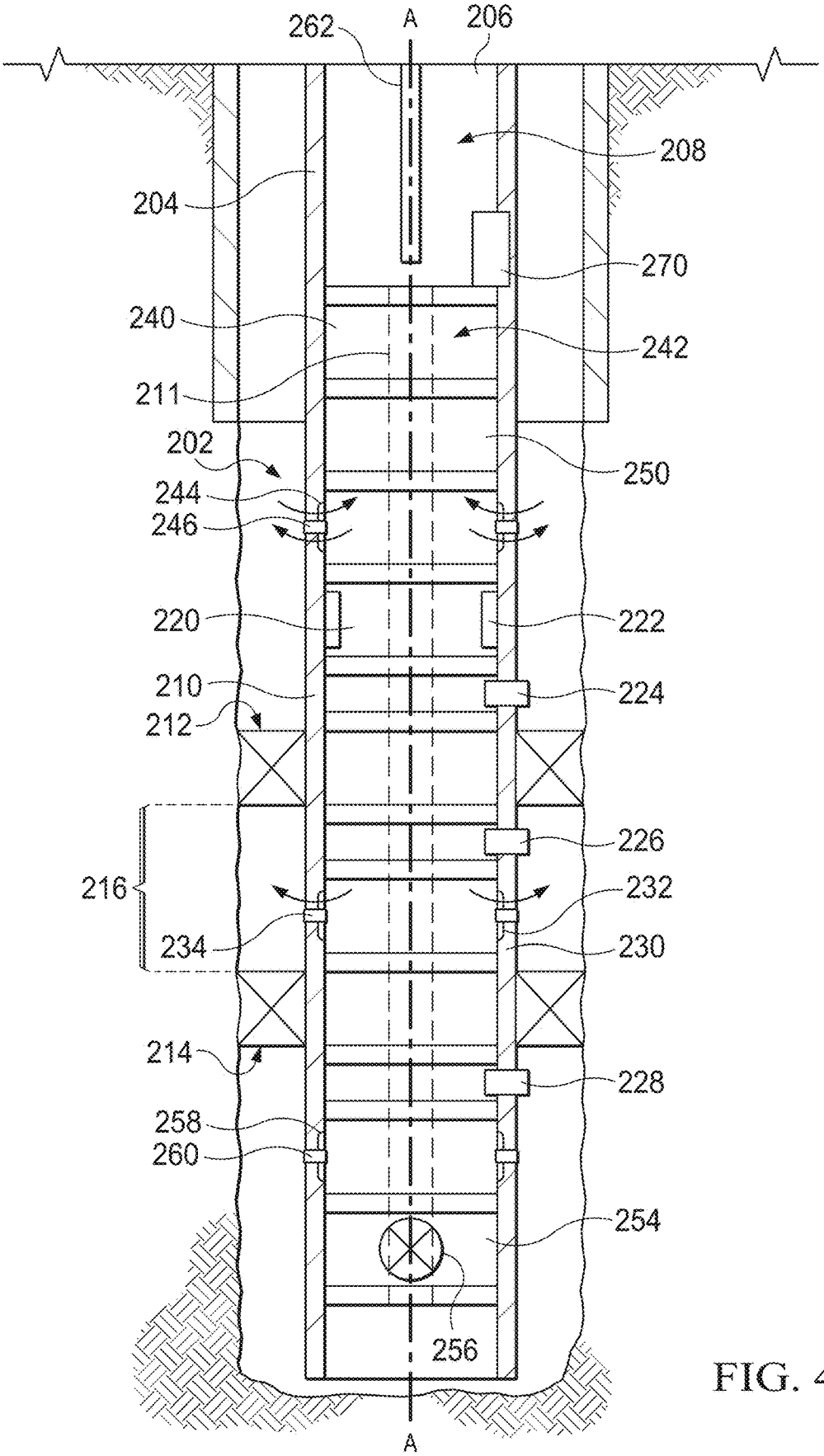

In FIG. 4F, the well testing tool 202 circulates a small amount of mud through the mud displacement valve 244 to test the function of the mud displacement valve 244. For example, the mud displacement valve 244 is activated to open the communication port(s) 246 between the central bore 206 and the annulus between the housing 210 and the wall of the wellbore 102 adjacent to the mud displacement valve 244. An operator can circulate mud or other fluid between the testing string and the annulus through the communication ports(s) 246 to test the functionality of the mud displacement valve 244. After the mud circulation test, the communication port(s) 246 of the mud displacement valve 244 is closed.

Figure 4G:
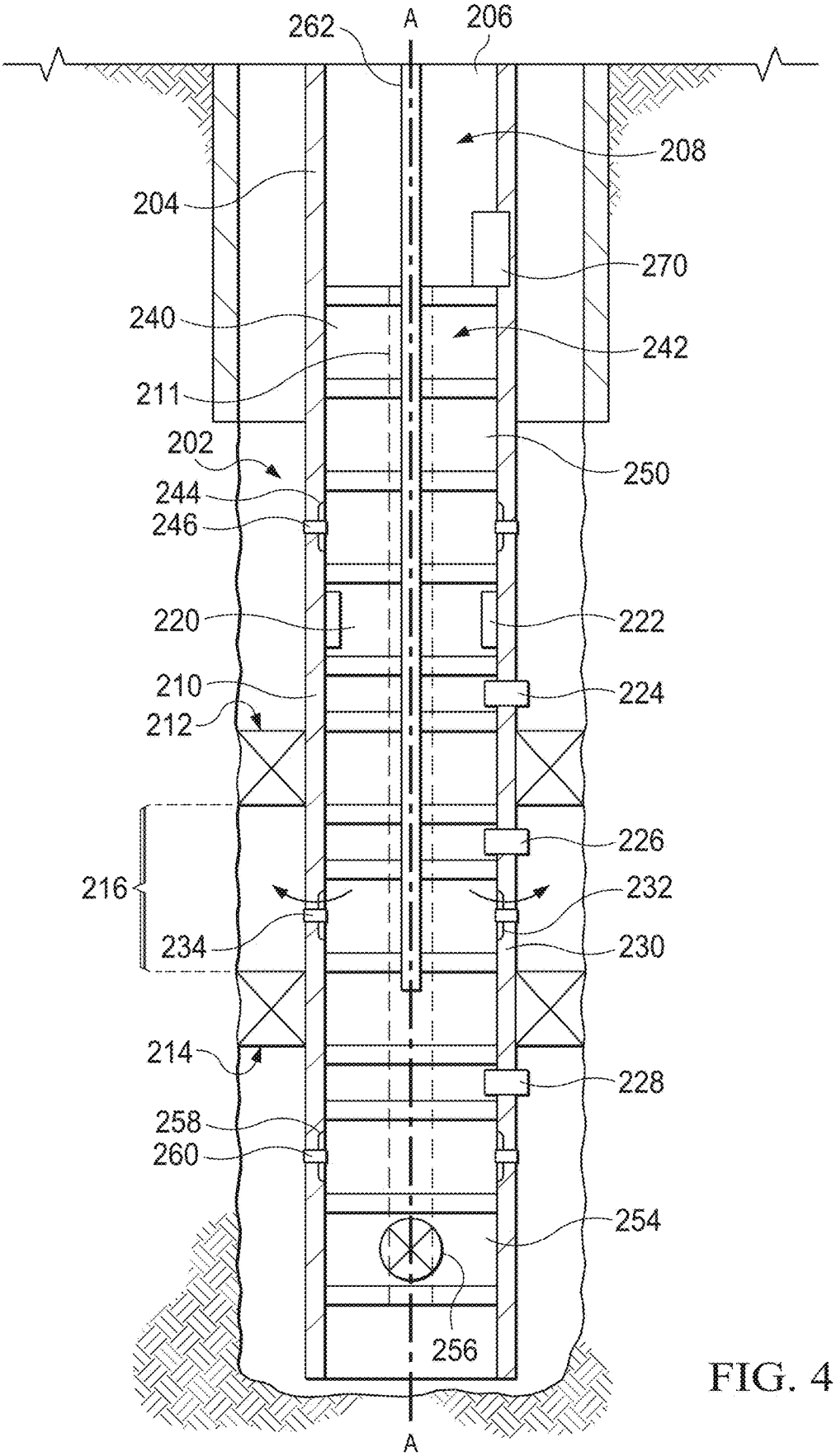

In FIG. 4G, the well testing tool 202 performs a well stimulation test, and optionally performs an acid treatment test prior to the well stimulation test. In some implementations, to prepare for a well stimulation test, the coil tubing 262 (or other form of the communication module 208) is run inside central bore 206 of the well testing tool 202 down to a depth proximate to the second, lower packer 214, and introduces inhibit water to the well testing tool to displace mud in the well testing tool 202. Subsequently, the well testing tool 202 can perform the well stimulation test, as hydrocarbon from the isolated zone of interest is in contact with the well testing tool 202, for example, the straddle tubing 230 of the well testing tool 202. In some examples, if the well is flowing freely and communication is not performed over the coil tubing 262, then the coil tubing 262 can be pulled out of hole during stimulation testing to retrieve hydrocarbon samples. In certain examples, if the well is not flowing freely, the well testing system 200 can pump nitrogen downhole to the well testing tool 202, for example, using the coil tubing 262, to reduce hydrostatic pressure inside the testing string 204 and after collecting hydrocarbon samples, and the coil tubing 262 can then be pulled out of hole. For example, during a nitrogen pumping sequence, nitrogen is pumped down the hole inside the coil tubing and is returned to the surface on the outside of coil tubing (however, still inside the inner diameter of the testing string 204). When nitrogen is pumped inside the inner diameter of the testing string 204, it reduces hydrostatic pressure of the column inside the testing string 204 and therefore allows reservoir fluid to flow back to the surface inside the testing string 204. This method can be used when the reservoir pressure is not sufficient to overcome hydrostatic pressure itself to flow to surface. After flowing the fluid back to surface, the upper shut in valve 250 can be closed to test the pressure build up, as described later.

Figure 4H:
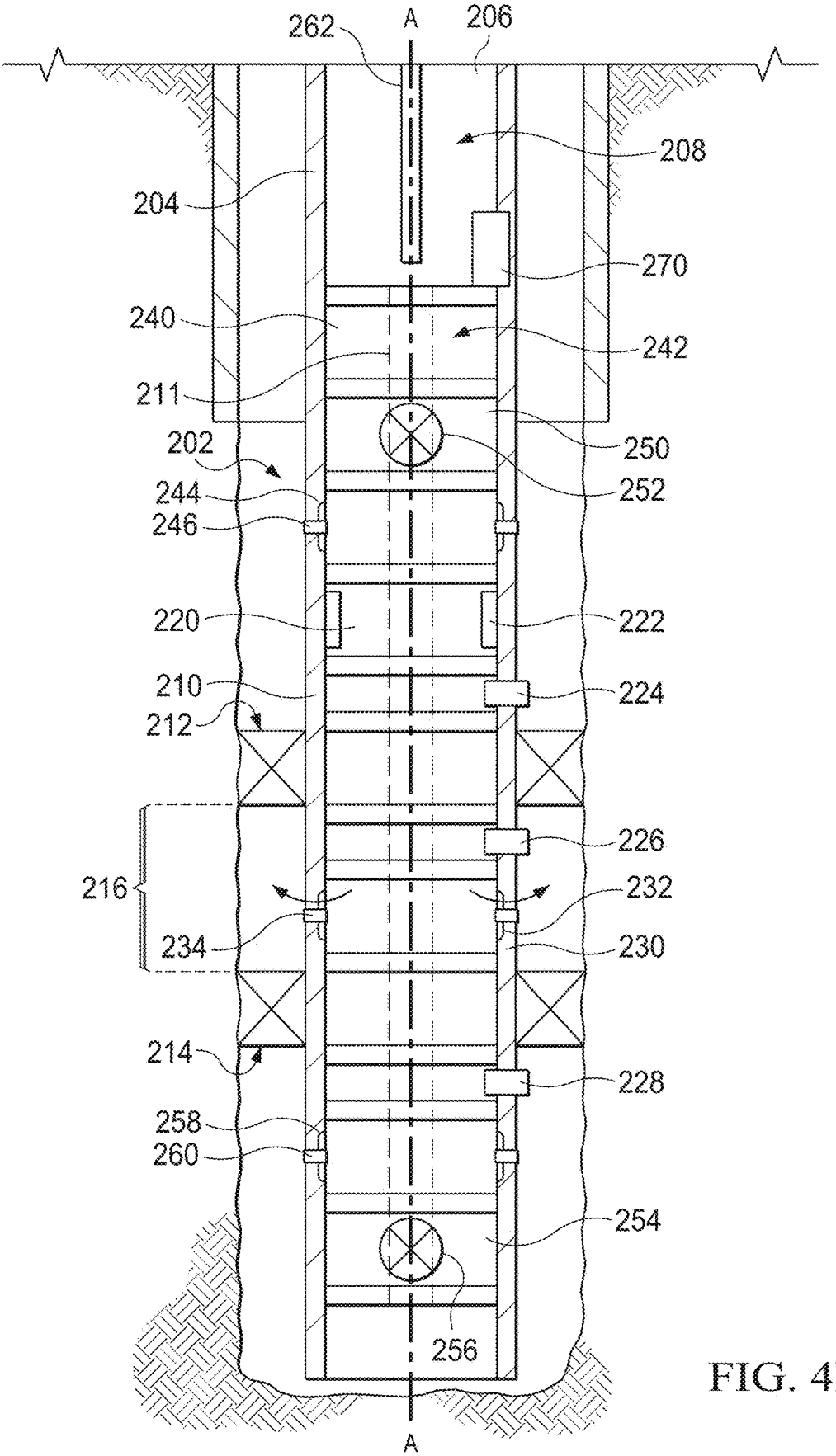

In FIG. 4H, the well testing tool 202 performs a final pressure buildup. For example, the well testing tool closes upper shut-in valve 250 to read a final pressure buildup at the well testing tool 202, for example, at one or more of the pressure sensors 224, 226, or 228.

Figure 4I:
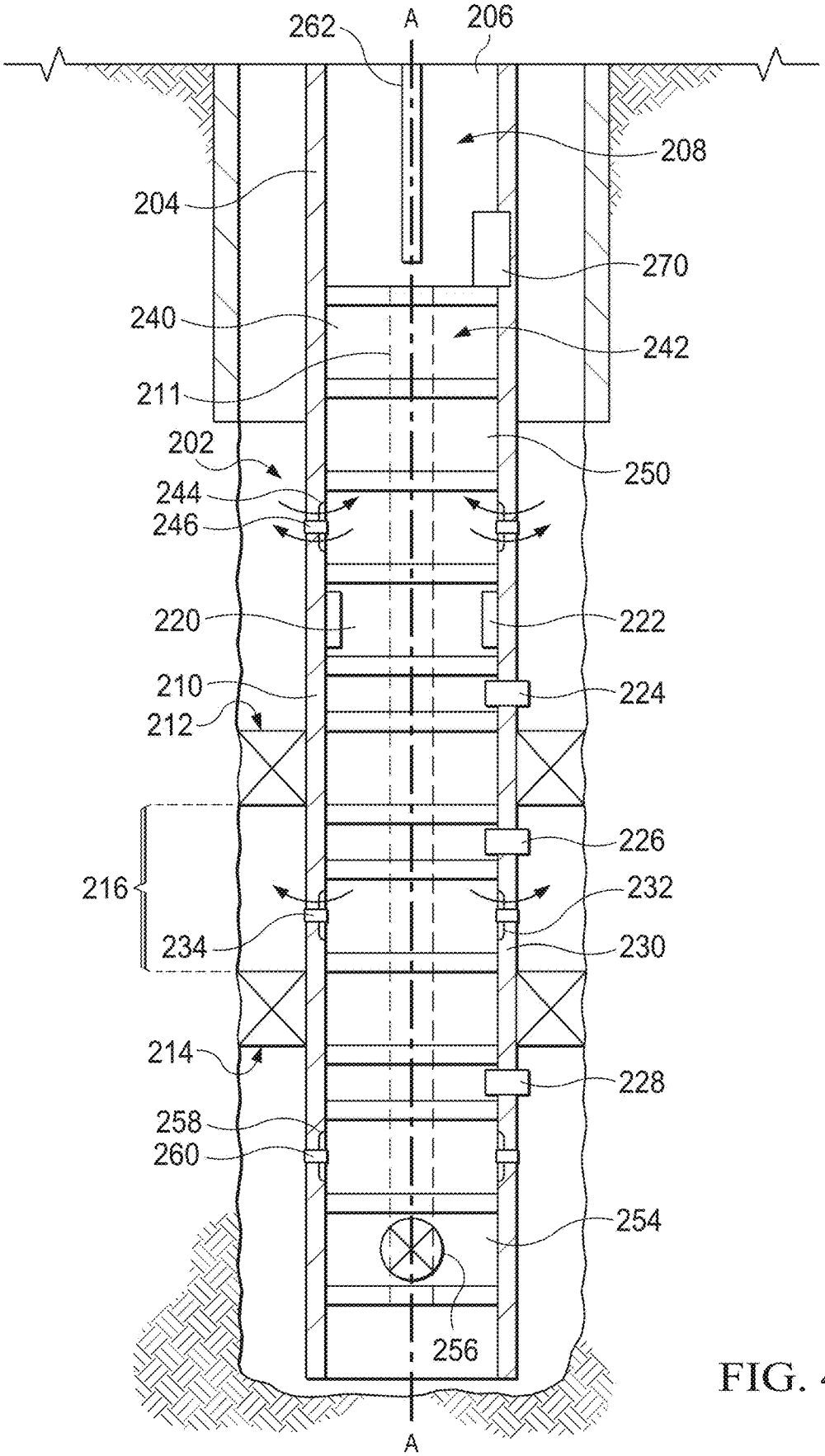

In some implementations, the well testing tool 202 performs a well kill operation following the well stimulation testing, for example, to finish the open hole testing and to allow for the decision to either complete the well if results are satisfying or abandon well if it is determined that the well does not produce hydrocarbons at a minimum threshold rate. For example, in FIG. 4H, the upper shut-in valve 250 is closed, and the testing string 204 is at least partially filled with kill fluid uphole of the upper shut-in valve 250. In some examples, coil tubing 262 delivers kill fluid to the well testing tool 202 uphole of the closed upper shut-in valve 250. In some instances, such as shown in FIG. 4I, the upper shut-in valve 250 is opened to allow the kill fluid to access and enter the formation through the opened straddle communication port(s) 234 of the straddle tubing 230, the opened communication port(s) 246 of the mud displacement valve 244, or both the straddle communication port(s) 234 and communication port(s) 246. The well testing tool 202 can then perform a full reverse circulation of the testing string 204 with kill fluid.

Figure 4J:
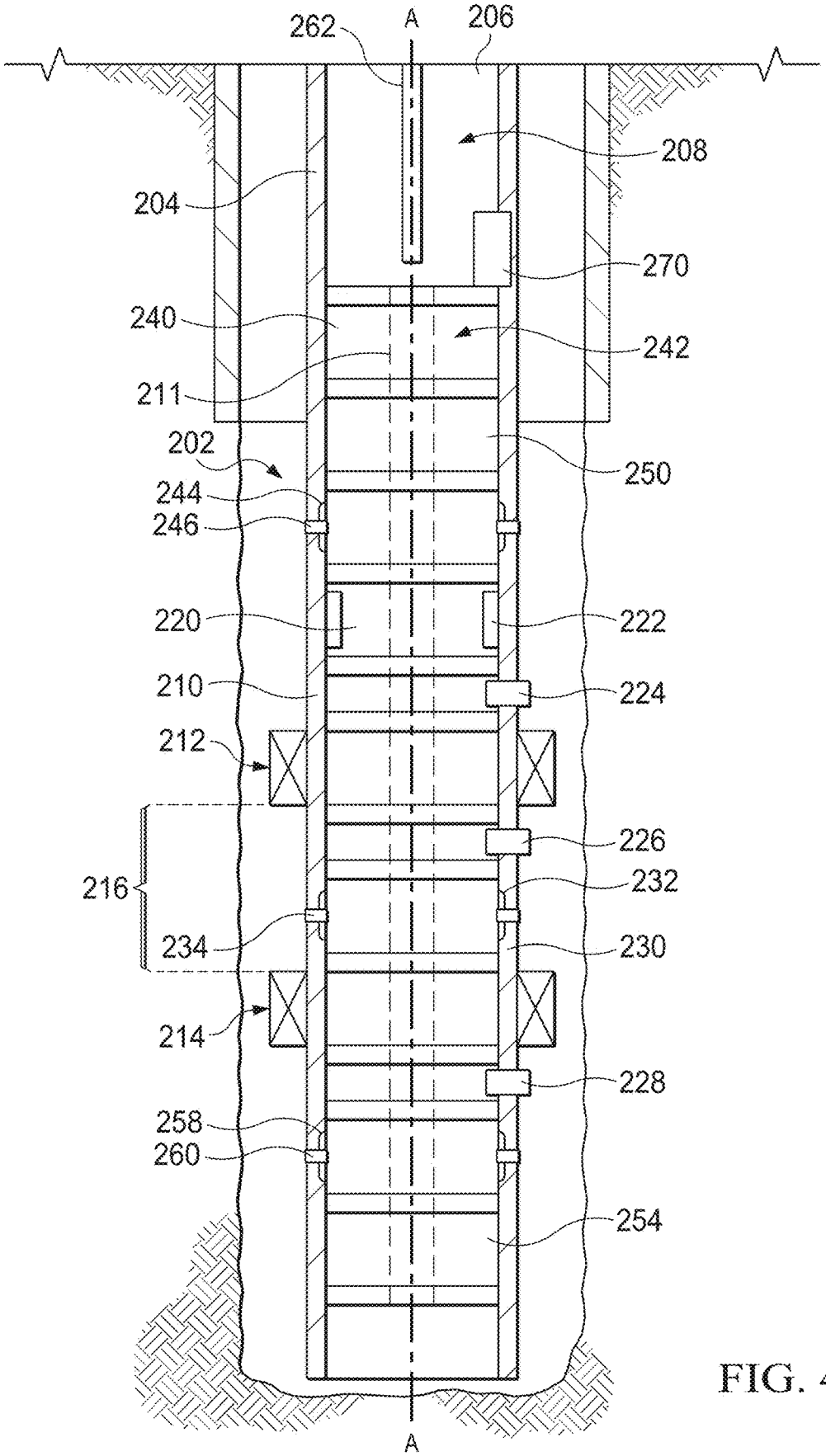

In FIG. 4J, the well testing tool 202 is unseated from its position in the wellbore in order to position itself in a different zone of interest in the wellbore 102 or pulled out of hole. For example, FIG. 4J shows the mud displacement valve 244 having been closed, the lower shut-in valve 254 having been opened, the straddle communication port(s) 234 of the straddle tubing 230 having been closed, and the first packer 212 and second packer 214 having been deactivated (e.g., deflated) and unseated. In some implementations, the well testing tool 202 can then perform one or more reverse circulation operations, direct circulation operations, or both, until uniform fluid properties appear at the surface of the well. Also, if the coil tubing 262 (or other communication module) has not already been retrieved, then the coil tubing 262 can be retracted from the wellbore 102.

The well testing tool 202 can then be moved to a different target depth in the wellbore 102 to perform additional testing operations, or retrieved from the wellbore 102. The well testing tool 202 can be used to test any number of target depths in the wellbore 102, for example, since the components of the well testing tool 202 can be activated and deactivated many times during a testing sequence.

Figure 5:
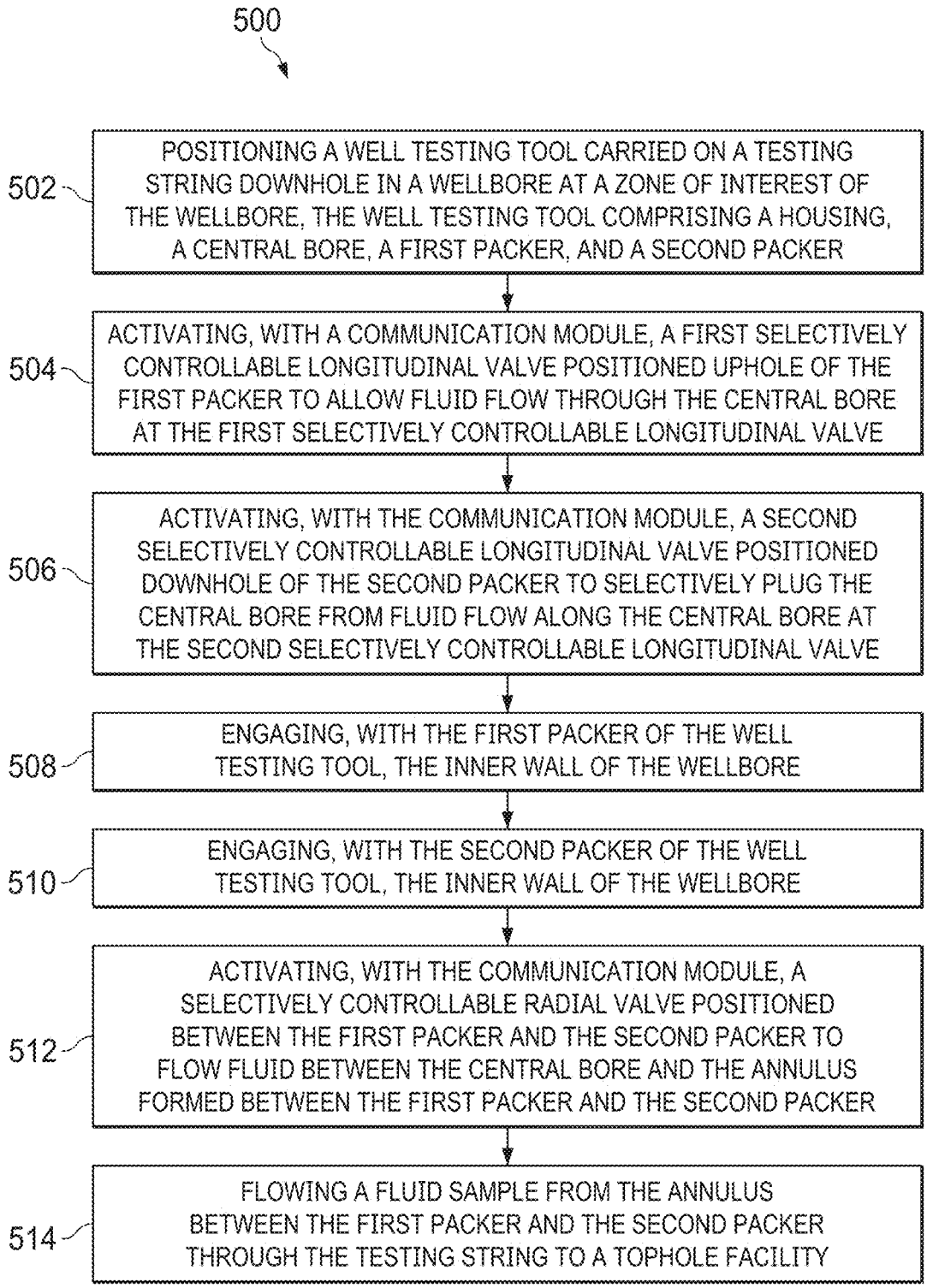
FIG. 5 is a flowchart describing an example method for testing a fluid in a wellbore.

FIG. 5 is a flowchart describing an example method 500 for testing a fluid in a wellbore, for example, performed by the example well testing tool 200 in the wellbore 102 of the example well testing system 200 of FIGS. 2 and 4A-4J. At 502, a well testing tool carried on a testing string is positioned downhole in a wellbore at a zone of interest of the wellbore. The well testing tool includes a housing, a central bore extending from a first longitudinal end to a second, opposite longitudinal end of the well testing tool, and a first packer and a second packer that circumscribe a portion of the housing of the well testing tool. The first packer is positioned uphole of the second packer, and the well testing tool is configured to define an annulus between the housing and an inner wall of the wellbore. At 504, a first selectively controllable longitudinal valve positioned uphole of the first packer is activated with a communication module to allow fluid flow through the central bore at the first selectively controllable longitudinal valve. At 506, a second selectively controllable longitudinal valve positioned downhole of the second packer is activated with the communication module to selectively plug the central bore from fluid flow along the central bore at the second selectively controllable longitudinal valve. At 508, the first packer of the well testing tool engages with the inner wall of the wellbore. At 510, the second packer of the well testing tool engages with the inner wall of the wellbore. At 512, a selectively controllable radial valve positioned between the first packer and the second packer is activated with the communication module to flow fluid between the central bore and the annulus formed between the first packer and the second packer. At 514, a fluid sample flows from the annulus between the first packer and the second packer through the testing string to a tophole facility.

A number of implementations have been described. Nevertheless, it will be understood that various modifications may be made without departing from the spirit and scope of the disclosure.

What is claimed is:

1. A method for testing a fluid in a wellbore, the method comprising:

positioning a well testing tool carried on a testing string downhole in a wellbore at a zone of interest of the wellbore, the well testing tool comprising a housing, a central bore extending from a first longitudinal end to a second, opposite longitudinal end of the well testing tool, and a first packer and a second packer that circumscribe a portion of the housing of the well testing tool, the first packer positioned uphole of the second packer, the well testing tool configured to define an annulus between the housing and an inner wall of the wellbore;

activating, with a communication module, a first selectively controllable longitudinal valve positioned uphole of the first packer to allow fluid flow through the central bore at the first selectively controllable longitudinal valve;

activating, with the communication module, a second selectively controllable longitudinal valve positioned downhole of the second packer to selectively plug the central bore from fluid flow along the central bore at the second selectively controllable longitudinal valve;

engaging, with the first packer of the well testing tool, the inner wall of the wellbore;

engaging, with the second packer of the well testing tool, the inner wall of the wellbore;

activating, with the communication module, a selectively controllable radial valve positioned between the first packer and the second packer to flow fluid between the central bore and the annulus formed between the first packer and the second packer, the communication module comprising at least one of smart coil tubing, coil tubing, slickline, or e-line, and the communication module comprising a transmitter carried on the smart coil tubing, coil tubing, slickline, or e-line and configured to transmit signals to and receive signals from the first selectively controllable longitudinal valve, the second selectively controllable longitudinal valve, the selectively controllable radial valve, the first packer, and the second packer, and activating the selectively controllable radial valve with the communication module comprises positioning the transmitter of the communication module downhole in the wellbore within the housing of the well testing tool and radially adjacent to the selectively controllable radial valve to activate the selectively controllable radial valve; and flowing a fluid sample from the annulus between the first packer and the second packer through the testing string to a tophole facility.

2. The method of claim 1, further comprising:

measuring a pressure in the annulus between the first packer and the second packer with a pressure sensor positioned on the housing of the well testing tool; and communicating the measured pressure from the pressure sensor to the tophole facility with the communication module.

3. The method of claim 1, wherein flowing the fluid sample from the annulus to a tophole facility comprises flowing the fluid sample to the tophole facility through a fluid communication pathway of the communication module.

4. The method of claim 1, wherein running the well testing tool downhole in the wellbore comprises running the well testing tool to an open-hole portion of the wellbore, engaging the wall of the wellbore with the first packer comprises engaging a wall of the open-hole portion of the wellbore with the first packer, and engaging the wall of the wellbore with the second packer comprises engaging the wall of the open-hole portion of the wellbore with the second packer.

5. The method of claim 1, wherein engaging the wall of the wellbore with the first packer and the second packer comprises isolating a zone of interest of the wellbore between the first packer and the second packer.

6. The method of claim 1, comprising, in response to activating the selectively controllable radial valve with the communication module, activating a second selectively controllable radial valve positioned uphole of the first packer with the communication module to flow fluid between the central bore and the annulus formed uphole of the first packer.

7. The method of claim 1, comprising, in response to positioning the well testing tool carried on the testing string downhole in the wellbore, at least one of pressure testing the well testing tool or drift testing the well testing tool.

8. The method of claim 1, comprising, in response to activating the selectively controllable radial valve with the communication module, treating the zone of interest of the wellbore with an acid treatment.

9. The method of claim 1, further comprising:

deactivating the selectively controllable radial valve to plug fluid flow between the central bore and the annulus formed between the first packer and the second packer;

disengaging the first packer from the wall of the wellbore;

disengaging the second packer from the wall of the wellbore; and positioning the well testing tool carried on the testing string at a second, different zone of interest of the wellbore.

10. A well testing system for use in a wellbore, the well testing system comprising:

a retrievable well testing tool comprising a housing and a central bore, and configured to be positioned in a wellbore of a well, the well testing tool comprising:

a first packer and a second packer that circumscribe a portion of the housing of the well testing tool, the first packer positioned uphole of the second packer, the first packer and the second packer configured to selectively engage and seal against a wall of the wellbore;

a first selectively controllable radial valve uphole of the first packer to selectively communicate fluid between the central bore and an annulus uphole of the first packer, the annulus being between the well testing tool and the wall of the wellbore;

a second selectively controllable radial valve between the first packer and the second packer to selectively communicate fluid between the central bore and the annulus between the first packer and the second packer;

a first selectively controllable longitudinal valve uphole of the first packer to selectively plug the central bore from fluid flow along the central bore;

a second selectively controllable longitudinal valve downhole of the second packer to selectively plug the central bore from fluid flow along the central bore; and a receiver communicatively coupled to the first packer, second packer, first selectively controllable radial valve, second selectively controllable radial valve, first selectively controllable longitudinal valve, and second selectively controllable longitudinal valve; and a communication module configured to communicate with the receiver to control activation of the first packer, second packer, first selectively controllable radial valve, second selectively controllable radial valve, first selectively controllable longitudinal valve, and second selectively controllable longitudinal valve, the communication module comprising at least one of smart coil tubing, coil tubing, slickline, or e-line, and comprising a transmitter at a downhole end of the communication module and positioned within the housing of the well testing tool and radially adjacent to the receiver of the well testing tool to communicate with the receiver based on the transmitter being radially adjacent to the receiver.

11. The well testing system of claim 10, wherein the first selectively controllable radial valve comprises a mud displacement valve, the mud displacement valve comprising communication ports fluidly coupling the central bore of the well testing tool with the annulus of the wellbore adjacent the mud displacement valve, the communication ports configured to selectively actuate open and closed.

12. The well testing system of claim 10, comprising a straddle tubing formed in the housing of the well testing tool between the first packer and the second packer, the straddle tubing comprising the second selectively controllable radial valve, the second selectively controllable radial valve comprising straddle communication ports configured to selectively actuate open and closed.

13. The well testing system of claim 10, wherein the communication module comprises the transmitter at the end of the communication module, the transmitter configured to transmit and receive signals from the well testing tool.

14. The well testing system of claim 13, wherein the communication module comprises a fluid communication pathway configured to transmit fluids between a downhole end of the communication module and an opposite, uphole end of the communication module.

15. The well testing system of claim 10, wherein the well testing tool comprises a communication device complementary with the communication module and configured to communicate with the communication module.

16. The well testing system of claim 15, wherein the communication device comprises the receiver of the well testing tool.

17. The well testing system of claim 10, wherein the communication module comprises at least one of a telemetric communication, a wireline communication, a wired communication over cables, a wireless communication with receivers and transmitters, or a drop plug communication.

18. The well testing system of claim 10, wherein the central bore comprises a full-bore pass through along an entire longitudinal length of the well testing tool, the central bore configured to allow pass through of the communication module through the central bore.

19. The well testing system of claim 10, further comprising a controller communicatively coupled to the first packer, the second packer, the first selectively controllable radial valve, the second selectively controllable radial valve, the first selectively controllable longitudinal valve, and the second selectively controllable longitudinal valve, the controller configured to selectively activate the first packer, the second packer, the first selectively controllable radial valve, the second selectively controllable radial valve, the first selectively controllable longitudinal valve, and the second selectively controllable longitudinal valve according to a pre-programmed testing sequence.

20. The well testing system of claim 19, wherein the well testing tool comprises a downhole logic tool coupled to the well testing tool and comprising the controller, the downhole logic tool comprising interlocks configured to prevent activation of a component of the well testing tool out of sequence from the pre-programmed testing sequence.

21. The well testing system of claim 10, wherein the well testing tool further comprises a pressure sensor coupled to the housing and positioned between the first packer and the second packer, the pressure sensor configured to monitor a pressure in an annulus between the first packer and second packer and between the second selectively controllable valve and a wall of the wellbore.

22. The well testing system of claim 21, wherein the well testing tool further comprises:

a second pressure sensor coupled to the housing and positioned uphole of the first packer, the second pressure sensor configured to monitor a pressure in the annulus uphole of the first packer; and a third pressure sensor coupled to the housing and positioned downhole of the second packer, the third pressure sensor configured to monitor a pressure in the annulus downhole of the second packer.

23. The well testing system of claim 10, wherein the well testing tool further comprises:

a backup packer positioned uphole of the first packer and configured to selectively engage and seal against the wall of the wellbore; and a backup sleeve valve positioned between the first packer and the backup packer, the backup sleeve valve configured to selectively flow fluid between the central bore and a portion of the annulus between the first packer and the backup packer.

24. The well testing system of claim 10, wherein the well testing tool further comprises:

a backup packer positioned downhole of the second packer and configured to selectively engage and seal against the wall of the wellbore; and a backup sleeve valve positioned between the second packer and the backup packer, the backup sleeve valve configured to selectively flow fluid between the central bore and a portion of the annulus between the second packer and the backup packer.

25. A well testing tool for use in a wellbore, the well testing tool comprising:

a first packer and a second packer circumscribing a portion of a housing of the well testing tool, the first packer and the second packer configured to selectively engage and seal against a wall of the wellbore;

a first selectively controllable radial valve uphole of the first packer to selectively communicate fluid between a central bore of the housing and an annulus uphole of the first packer, the annulus being between the well testing tool and the wall of the wellbore;

a second selectively controllable radial valve between the first packer and the second packer to selectively communicate fluid between the central bore and the annulus between the first packer and the second packer;

a first selectively controllable longitudinal valve uphole of the first packer to selectively plug the central bore from fluid flow along the central bore;

a second selectively controllable longitudinal valve downhole of the second packer to selectively plug the central bore from fluid flow along the central bore;

a pressure sensor coupled to the housing and positioned between the first packer and the second packer, the pressure sensor configured to monitor a pressure in an annulus between the first packer and second packer and between the second selectively controllable valve and a wall of the wellbore; and a downhole logic tool coupled to the well testing tool and comprising a controller communicatively coupled to the first packer, the second packer, the first selectively controllable valve, the second selectively controllable valve, and the pressure sensor, the controller configured to selectively activate the first packer, the second packer, the first selectively controllable radial valve, the second selectively controllable radial valve, the first selectively controllable longitudinal valve, the second selectively controllable longitudinal valve, and the pressure sensor according to a pre-programmed testing sequence, and the downhole logic tool comprising interlocks configured to prevent activation of a component of the well testing tool out of sequence from the pre-programmed testing sequence, the downhole logic tool configured to initiate the pre-programmed testing sequence in response to detection of a signal from a transmitter, wherein:

the pre-programmed testing sequence comprises a first stage of operation, a second stage of operation after the first stage of operation, and a third stage of operation after the second stage of operation, the first stage of operation comprising setting the first packer and the second packer and closing the second selectively controllable longitudinal valve, the second stage of operation comprising opening the second selectively controllable radial valve, the third stage of operation comprising closing the second selectively controllable radial valve, opening the second selectively controllable longitudinal valve, and opening the first selectively controllable longitudinal valve, and the first stage of operation is initiated by a first signal from the transmitter, the second stage of operation is initiated by a second signal from the transmitter, and the third stage of operation is initiated by a third signal from the transmitter.

26. The well testing tool of claim 25, further comprising a communication module comprising at least one of a coil tubing, slickline, e-line, or drop plug, the communication module configured to carry the transmitter to be positioned within the well testing tool and radially adjacent to the downhole logic tool.

* * * * *